US008714357B2

(12) United States Patent
Ridgeway

(10) Patent No.: US 8,714,357 B2
(45) Date of Patent: May 6, 2014

(54) PACKAGING SYSTEM

(75) Inventor: Devin C. Ridgeway, Chula Vista, CA (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 78 days.

(21) Appl. No.: 12/798,579

(22) Filed: Apr. 6, 2010

(65) Prior Publication Data

US 2011/0240515 A1 Oct. 6, 2011

(51) Int. Cl.
*B65D 81/07* (2006.01)

(52) U.S. Cl.
USPC ..... 206/583; 206/588

(58) Field of Classification Search
USPC ..... 206/583, 588, 521, 806, 594, 591, 495, 206/586
See application file for complete search history.

(56) References Cited

U.S. PATENT DOCUMENTS

| | | | | |
|---|---|---|---|---|
| 4,852,743 | A | 8/1989 | Ridgeway | |
| 4,923,065 | A | 5/1990 | Ridgeway | |
| 5,071,009 | A | 12/1991 | Ridgeway | |
| 5,287,968 | A | 2/1994 | Ridgeway | |
| 5,388,701 | A | 2/1995 | Ridgeway | |
| 5,669,506 | A * | 9/1997 | Lofgren et al. | 206/583 |
| 5,678,695 | A | 10/1997 | Ridgeway et al. | |
| 5,694,744 | A | 12/1997 | Jones | |
| 5,762,200 | A | 6/1998 | Goudreau | |
| 5,893,462 | A | 4/1999 | Ridgeway | |
| 5,894,932 | A | 4/1999 | Harding et al. | |
| 5,967,327 | A | 10/1999 | Jones | |
| 5,975,307 | A | 11/1999 | Harding et al. | |
| 6,010,006 | A | 1/2000 | Ridgeway et al. | |
| 6,119,863 | A * | 9/2000 | Lofgren et al. | 206/583 |
| 6,148,590 | A | 11/2000 | Ridgeway et al. | |
| 6,148,591 | A | 11/2000 | Ridgeway et al. | |
| 6,158,589 | A | 12/2000 | Smith et al. | |
| 6,223,901 | B1 | 5/2001 | Lofgren et al. | |
| 6,289,655 | B1 | 9/2001 | Ridgeway et al. | |
| 6,302,274 | B1 | 10/2001 | Ridgeway | |
| 6,311,844 | B1 | 11/2001 | Ridgeway et al. | |
| 6,675,973 | B1 | 1/2004 | McDonald et al. | |
| 6,913,147 | B2 | 7/2005 | Mueller et al. | |
| 7,086,534 | B2 | 8/2006 | Roesel et al. | |
| 7,743,924 | B2 * | 6/2010 | McDonald et al. | 206/583 |
| 7,918,339 | B2 * | 4/2011 | Kashiwabara | 206/583 |
| 8,028,838 | B2 * | 10/2011 | McDonald et al. | 206/583 |

(Continued)

FOREIGN PATENT DOCUMENTS

GB 2 264 289 A 8/1993

*Primary Examiner* — Steven A. Reynolds
(74) *Attorney, Agent, or Firm* — Daniel B. Ruble

(57) ABSTRACT

A packaging system includes a retention frame and a tray. The retention frame includes a panel and a retention sheet. The panel has a first fold line defining a first flap and a remainder portion. The remainder portion defines a panel opening. The retention sheet is attached to the first flap and the remainder portion so that the retention sheet extends over the panel opening and the first fold line. The tray includes a tray frame defining a tray opening. A tray sheet is attached to the tray frame and extends over the tray opening. The tray is configured for positioning between the retention sheet and the remainder portion of the retention frame to juxtapose the tray opening with the panel opening. A product may be supported on the tray sheet to suspend and retain the product between the retention sheet and the tray sheet over the juxtaposed tray and panel openings.

19 Claims, 29 Drawing Sheets

(56) References Cited

U.S. PATENT DOCUMENTS

2004/0108239 A1 6/2004 McDonald et al.
2004/0140243 A1* 7/2004 Roesel et al. ..... 206/583
2006/0102515 A1* 5/2006 McDonald et al. ..... 206/583
2008/0128316 A1* 6/2008 McDonald et al. ..... 206/583
2008/0223750 A1* 9/2008 McDonald et al. ..... 206/583

* cited by examiner

PACKAGING SYSTEM

The present invention relates to a packaging system, for example, a packaging system used to protect a packaged product during shipment by suspending the product within a box.

BACKGROUND

Protective packaging structures may be used to help protect a product during transport, for example, from physical shock, dust, and other contaminants. For example, a product may be enclosed in a box with additional packing materials (e.g., crumpled paper, air-filled plastic cushions, molded foam) to restrain the product movement inside the box and to cushion the product.

One type of packaging system is known as "suspension packaging." In typical suspension packaging, the packaged product is suspended between two sheets each attached to opposing frames sized to fit within a corresponding box. Another type of packaging system is known as retention packaging. In typical retention packaging, a product is retained between a sheet and a rigid backing frame to which the sheet is attached. Examples of retention and suspension packaging are described in more detail in U.S. Pat. Nos. 4,852,743; 4,923,065; 5,071,009; 5,287,968; 5,388,701; 5,678,695; 5,893,462; 6,010,006; 6,148,590; 6,148,591; 6,289,655; 6,302,274; and 6,311,844, each of which is incorporated herein in its entirety by reference.

Suspension packaging and retention packaging systems each have advantages and disadvantages. For example, suspension packaging provides superior protection against shocks because the product is suspended within the box, but the system typically uses two frames and two sheets, which may present manufacturing challenges, for example, when the sheets have a tacky nature. Retention packaging provides manufacturing and cost advantages because a single retention frame and sheet may be used.

SUMMARY

A packaging system comprises a retention frame and a tray. The retention frame comprises a panel and a retention sheet. The panel has a first fold line defining a first flap and a remainder portion. The remainder portion defines a panel opening. The retention sheet is attached to the first flap and the remainder portion so that the retention sheet extends over the panel opening and the first fold line. The tray comprises a tray frame defining a tray opening. A tray sheet is attached to the tray frame and extends over the tray opening. The tray is configured for positioning between the retention sheet and the remainder portion of the retention frame to juxtapose the tray opening with the panel opening.

These and other objects, advantages, and features of various embodiments of the invention will be more readily understood and appreciated by reference to the detailed description and the drawings.

Figure 1:
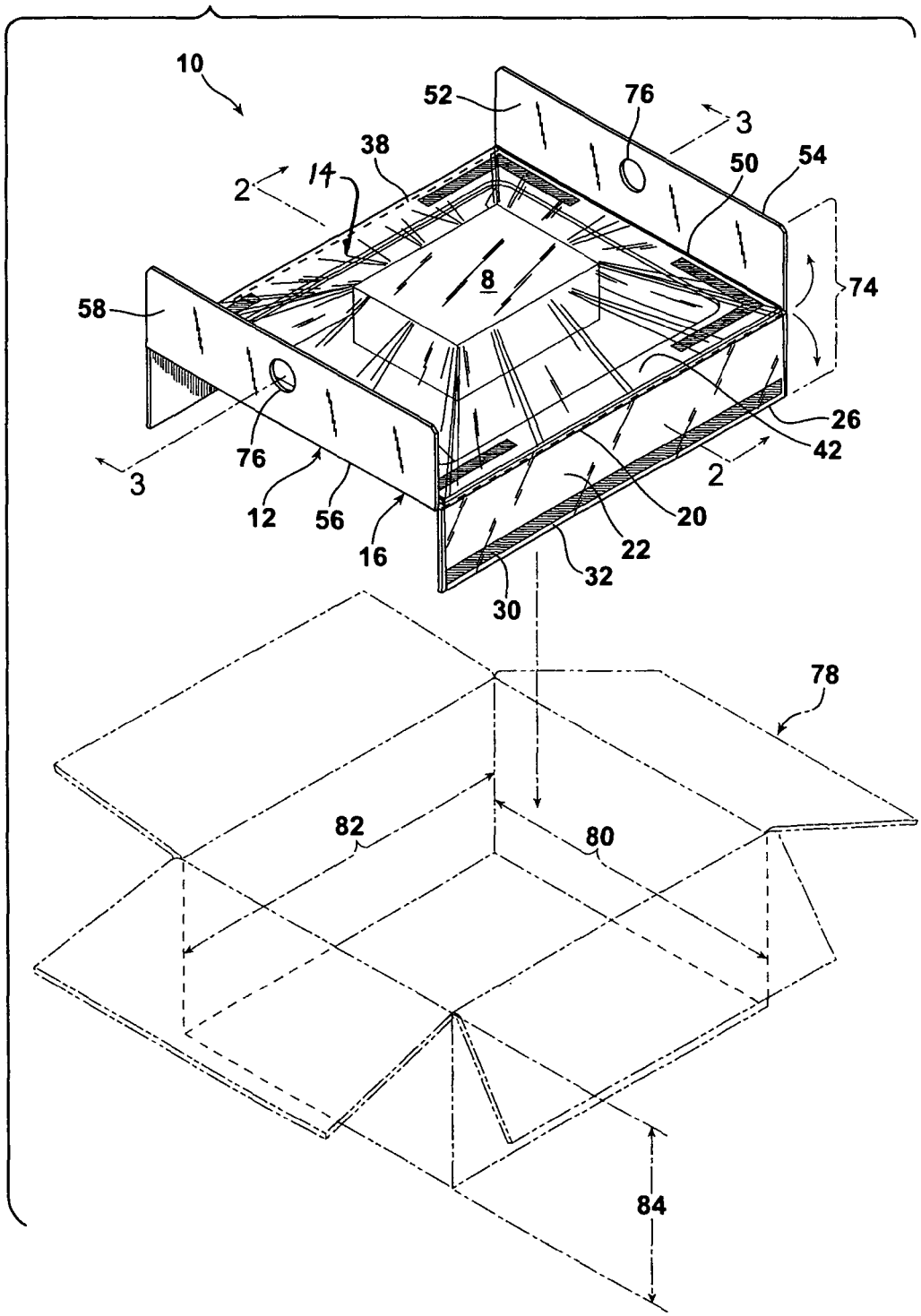
FIG. 1 is a representative perspective view of packaging system 10 having product 8 installed and configured for installation in box 78.

Various aspects of the subject matter disclosed herein are described with reference to the drawings. For purposes of simplicity, like numerals may be used to refer to like, similar, or corresponding elements of the various drawings. The drawings and detailed description are not intended to limit the claimed subject matter to the particular form disclosed. Rather, the intention is to cover all modifications, equivalents, and alternatives falling within the spirit and scope of the claimed subject matter.

DETAILED DESCRIPTION

In an embodiment of the invention, packaging system 10 comprises retention frame 12 and tray 14. (FIGS. 1-5.)

Retention Frame

Retention frame 12 comprises panel 16 and retention sheet 18. Panel 16 has a first fold line 20 that defines, or separates panel 16 into, first flap 22 and remainder portion 24.

First fold line 20 is spaced from, and may be generally parallel to, the bottom edge 26 of the first flap 22. A "fold line" as used herein (and as depicted in the drawings, for example as in FIGS. 4 and 5, as a broken line) represents a line along which a panel, frame, or other material may be creased, crimped, embossed, perforated, scored, or otherwise weakened so as to enhance the foldability of the panel, frame, or other material along the fold line. For example, first fold line 20 may include one or more through slits (not shown) extending partially along its length, leaving a sufficient portion of the fold line intact to securely join first flap 22 to remainder portion 24 of panel 16 so that first flap 22 is foldably connected to remainder portion 24. The slits through the fold line may facilitate folding the first flap along the fold line 20 by reducing the amount of panel material that has to be folded. As used herein, the term "generally" when used in conjunction with terms such as "parallel" or "perpendicular" is meant to indicate that the parallel or perpendicular orientation does not require mathematical precision, but rather indicates a moderate range of deviation from absolute parallel or perpendicular that is commonly acceptable as a level of accuracy for these terms within the container-folding field.

Figure 4:
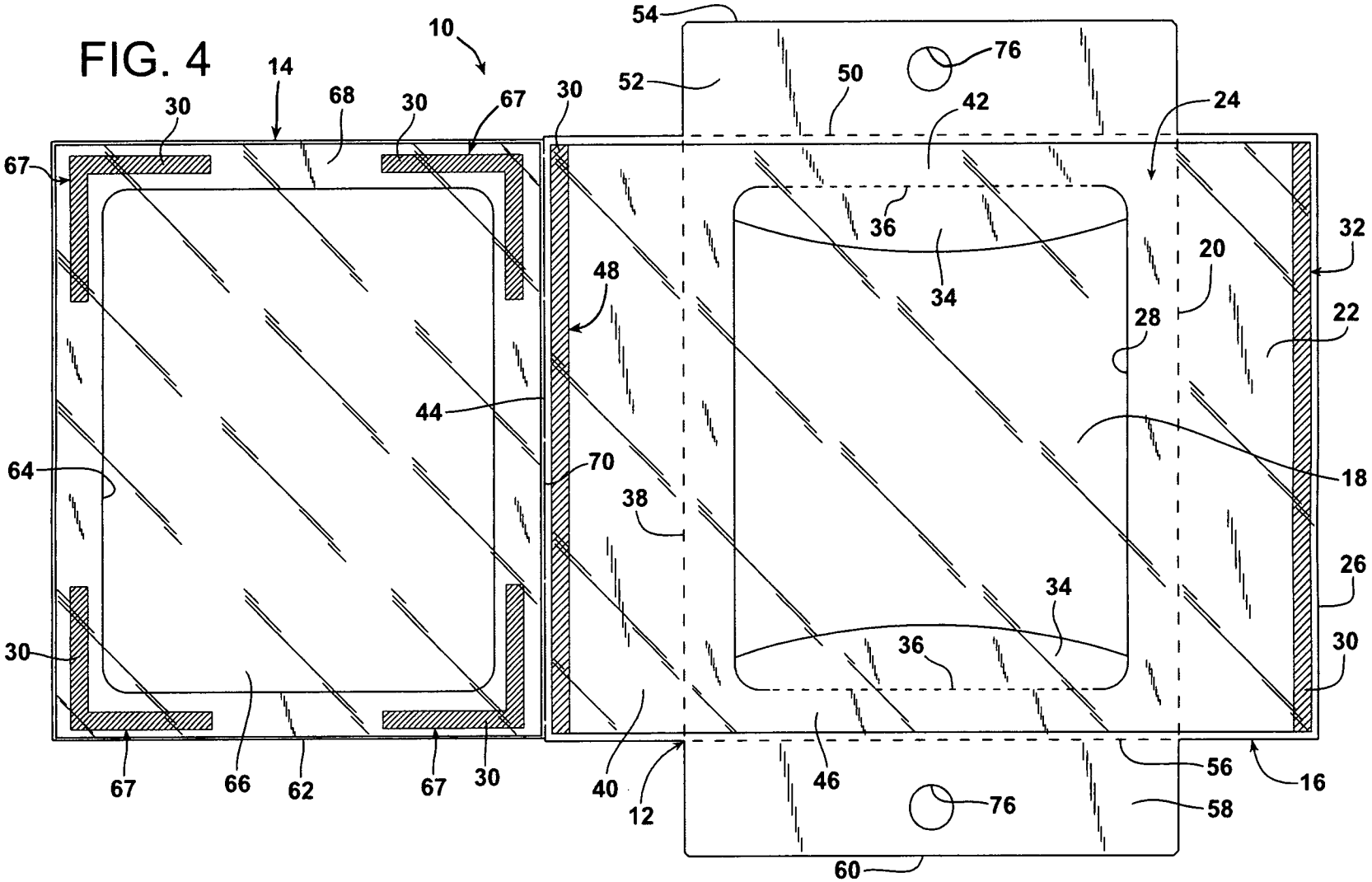
FIG. 4 is a representative top view of packaging system 10 in a lay-flat configuration.

Remainder portion 24 of panel 16 defines panel opening 28. Panel opening 28 may be larger than the product 8 to be packaged, that is, large enough that the packaged product 8 can pass through the panel opening. The panel 16 may comprise one or more panel door portions 34 extending into the panel opening 28 and foldably connected to the remainder portion 24 along one or more corresponding panel door fold lines 36. As such, the perimeter of panel opening 28 may be defined at least in part by the one or more panel door portion fold lines 36. As shown in FIG. 4, panel 16 comprises a pair of opposing panel door portions 34, although the panel may comprise one or more opposing pairs of opposing panel door portions.

Figure 24:
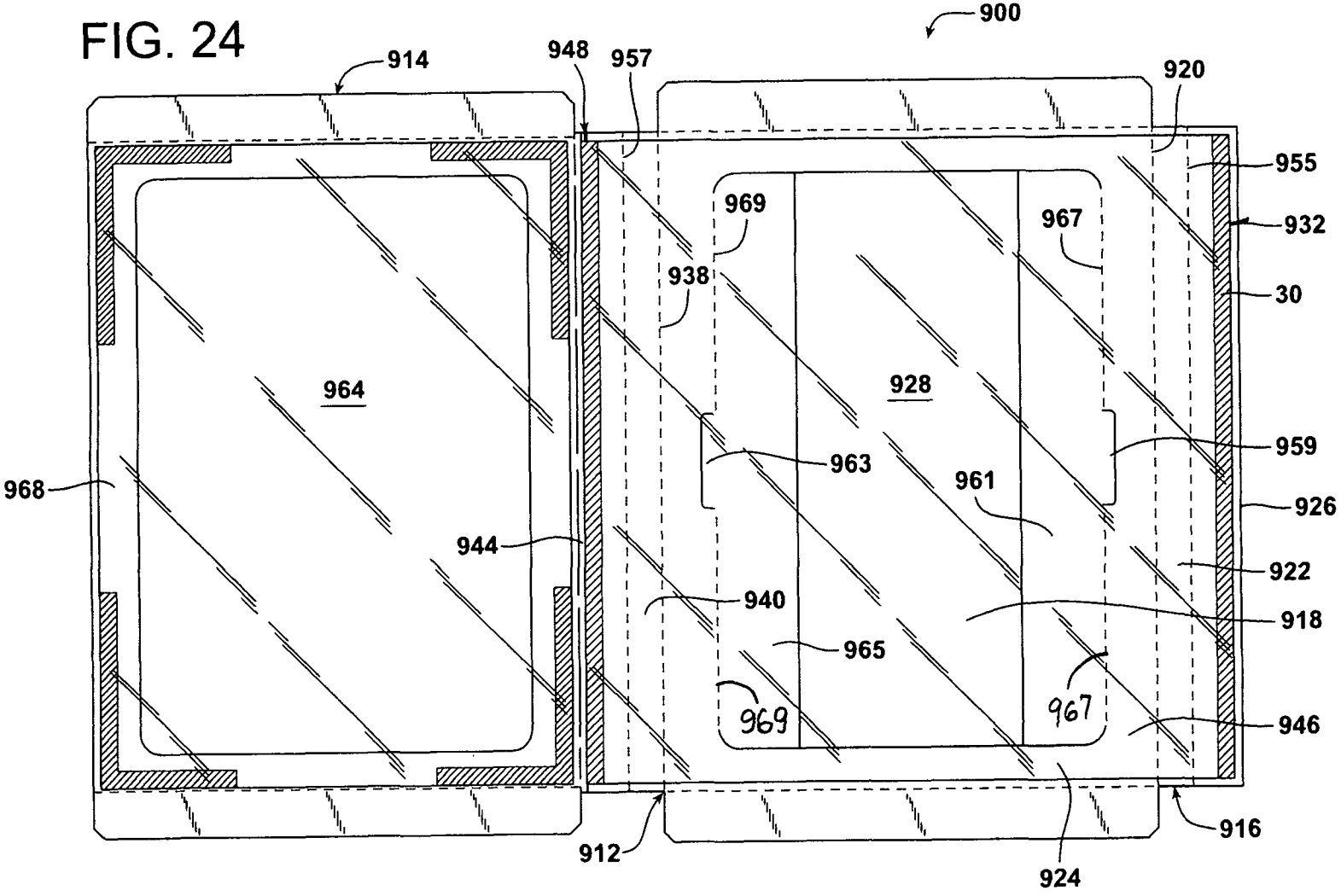
FIG. 24 is a representative top view of packaging system 900 in a lay-flat configuration.
Figure 25:
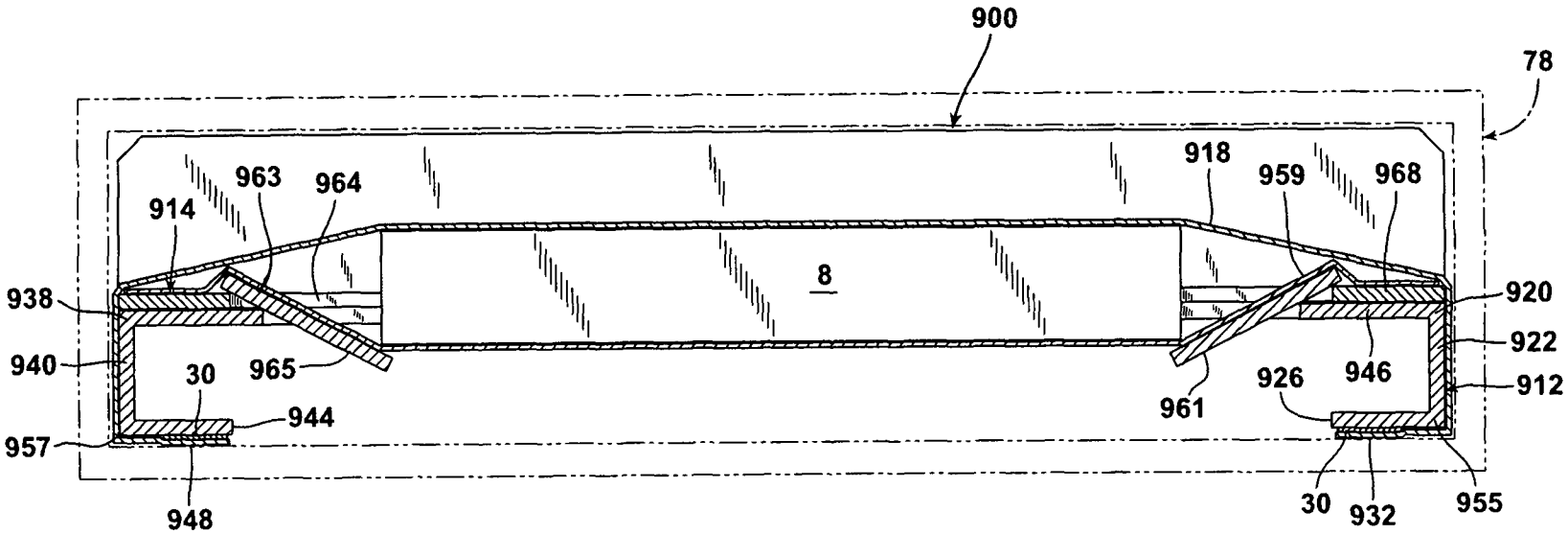
FIG. 25 is a representative sectional side view of packaging system 900 installed in box 78 and suspending product 8.

Retention sheet 18 is attached to first flap 22 and extends over (i.e., across) both first fold line 20 and panel opening 28 and is attached to remainder portion 24. In the drawings, retention sheet 18 is shown completely covering panel opening 28; in alternative embodiments the retention sheet may extend over the panel opening and only partially cover the panel opening (not illustrated). In the drawings, retention sheet 18 is shown attached to the first flap 22 and the remainder portion 24 by adhering with adhesive 30; however, the retention sheet may be attached to first flap and remainder portion 24, for example, by one or more of any of the following: adhering (e.g., with hot melt adhesive), gluing, heat welding, ultrasonic welding, stapling, tacking, fastening, clipping (see, e.g., U.S. Pat. No. 5,694,744 to Jones, which is incorporated herein in its entirety by reference), anchoring (see, e.g., FIG. 19 and related discussion herein), retaining and/or securing (see, e.g., U.S. Patent Application Publication 2004/0108239 A1 to McDonald et al. published Jun. 10, 2004, which is incorporated herein in its entirety by reference, and which discloses a sleeve having pockets or pouches for receiving a flap as shown in FIGS. 24-25 and related discussion therein). The retention and tray sheets of any embodiments described herein may be attached by one or more of any of the attachment ways described herein.

The retention sheet 18 may be attached to first flap 22 along first flap attachment zone 32 adjacent bottom edge 26 of first flap 22. The attachment zone 32 may comprise adhesive 30 and may extend continuously (as shown) or periodically (not illustrated) along the length of bottom edge 26 of first flap 22. Useful types of adhesives for attaching sheets to frames are known to those of skill in the art, and of course depend on the composition of the materials to be adhered. For example, a polyurethane-based sheet may be adhered with a polyurethane-based adhesive, such as a water-borne aliphatic polyurethane dispersion.

Remainder portion 24 of panel 16 may have second fold line 38 that defines, or separates remainder portion 24 into, second flap 40 and central panel portion 42. Central panel portion 42 is between the first fold line 20 and second fold line 38. Central panel portion 42 defines the panel opening 28 and may comprise panel opening border 46 surrounding the panel opening 28. Second fold line 38 may be spaced from, and may be generally parallel to, the bottom edge 44 of the second flap 40. Second fold line 38 may also be generally parallel to the first fold line 20.

The retention sheet 18 may be attached to second flap 40 of remainder portion 24 and extend over the second fold line 38. Similar to first flap 22, retention sheet 18 may be attached to the second flap 40 by any of the ways described herein, and as illustrated, by adhering with adhesive 30 along second flap attachment zone 48 adjacent bottom edge 44 of second flap 40. The attachment zone 48 may comprise adhesive 30 and may extend continuously (as shown) or periodically (not illustrated) along the length of bottom edge 44 of second flap 40.

The remainder portion 24 may have a third fold line 50 that defines, or separates remainder portion 24 into, a first leg portion 52 extending from the central panel portion 42 to define a top edge 54 of the first leg portion 52. The remainder portion 24 may have a fourth fold line 56 that defines, or separates remainder portion 24 into, a second leg portion 58 extending from the central panel portion 42 to define a top edge 60 of the second leg portion 52. The third fold line 50 is spaced from, and may be generally parallel to, the top edge 54 of the first leg portion 52. The fourth fold line 56 is spaced from, and may be generally parallel to, the top edge 60 of the second leg portion 58. The fourth fold line 56 may be generally parallel to third fold line 50. Either or both of the third fold line 50 and the fourth fold line 56 may be generally perpendicular to either or both of the first fold line 20 and the second fold line 38. The central panel portion 42 may be between the third and fourth fold lines 50, 56. The first, second, third, and fourth fold lines (20, 38, 50, 56) may collectively bound (e.g., circumscribe) central panel portion 42 of the remainder portion 24. The first and second leg portions 52, 58 may define finger holes 76.

In the lay-flat configuration, as shown in FIG. 4, the bottom edge 26 of first flap 22, the bottom edge 44 of second flap 40, the top edge 54 of first leg portion 52, and the top edge 60 of second leg portion 58 each form a portion of the exterior periphery of retention frame 12.

Panel

Panel 16, and any of the panels and tray frames of the various embodiments described herein, may comprise a substantially rigid, lightweight, foldable material, for example, panel 16, or any of the portions of panel 16 described herein, may be formed of one or more of any of the following materials: cellulosic-based materials (e.g., cardboard, corrugated cardboard, paperboard), plastic, and compressed foam. For example, panel 16 may comprise corrugated cardboard, for example, any of single-wall B-flute, C-flute, and/or E-flute corrugated cardboard, B/C double-wall corrugated cardboard, and/or EB double-wall corrugated cardboard. The panel, and any of the panels and tray frames of the various embodiments described herein, may have an average thickness of, for example, at most about, and/or at least about, any of the following thicknesses: 0.03, 0.06, 0.12, 0.18, 0.25, 0.3, 0.4, and 0.5 inches.

Retention Sheet

Retention sheet 18 may have a composition and thickness providing acceptable performance properties (e.g., flexibility, elasticity, optics, strength) for the given packaging application of expected use. The retention sheet may have a thickness of at most about any of the following: 10 mils, 6 mils, 5 mils, 4 mils, 3 mils, 2 mils, 1.5 mils, and 1 mil. (A "mil" is equal to 0.001 inch.) The retention sheet may also have a thickness of at least about any of the following: 0.5 mils, 1 mil, 1.5 mils, 2 mils, and 3 mils.

The retention sheet may have an elastic recovery in either or both of the transverse and longitudinal directions of at least about any of the following values: 60%, 65%, 70%, 75%, 80%, and 85%, measured according to ASTM D5459 at 100% strain, 30 seconds relaxation time, and 60 second recovery time.

The retention sheet may have a maximum load tear resistance in either or both of the transverse and longitudinal directions of at least about any of the following values: 400, 450, 500, 550, and 600 grams force, measured according to ASTM D1004.

The retention sheet may have a slow puncture maximum load of at least about any of the following values: 4, 4.5, 5, 5.5, 6, 6.5, and 7 pounds force, measured according to ASTM F1306 using a crosshead speed of 5 inches per minute.

The retention sheet may have a Young's modulus sufficient to withstand the expected handling and use conditions, yet may provide a "soft" feel that may be desirable for a packaging application. The retention sheet may have a Young's modulus of at least about any of the following values: 2,000; 2,500; 3,000; 3,500; and 4,000 pounds/square inch. The retention sheet may have a Young's modulus of no more than about any of the following values: 8,000; 10,000; 15,000; 20,000; 30,000; and 40,000 pounds/square inch. The Young's modulus is measured in accordance with ASTM D882, measured at a temperature of 73° F.

The retention sheet may be transparent so that the packaged article (e.g., product 8) may be visible through the retention sheet. "Transparent" as used herein means that the material transmits incident light with negligible scattering and little absorption, enabling objects to be seen clearly through the material under typical unaided viewing conditions (i.e., the expected use conditions of the material). The transparency (i.e., clarity) of the retention sheet may be at least about any of the following values: 65%, 70%, 75%, 80%, 85%, and 90%, measured in accordance with ASTM D1746.

The retention sheet may have a heat-shrink attribute. For example, the retention sheet may have any of a free shrink in at least one direction (i.e., machine or transverse directions), in each of at least two directions (i.e., machine and transverse directions), measured at any of 160° F. and 180° F. of at least about any of the following: 7%, 10%, 15%, 20%, 25%, 30%, 40%, 50%, 55%, 60%, and 65%. Alternatively, the retention sheet may be non-heat shrinkable (i.e., has a total free shrink of less than 5% measured at 160° F.). Unless otherwise indicated, each reference to free shrink in this application means a free shrink determined by measuring the percent dimensional change in a 10 cm×10 cm specimen when subjected to selected heat (i.e., at a certain temperature exposure) according to ASTM D 2732.

The retention sheet may comprise, for example, one or more fabrics, such as one or more of the following: wovens, knits, nonwovens, and openwork meshes (e.g., netting), spandex, including Lycra® brand spandex, and elastic fabrics.

The retention sheet may comprise one or more polymers, for example, one or more of any of the following polymers: thermoplastic polymers, polyolefins, polyethylene homopolymers (e.g., low density polyethylene), polyethylene copolymers (e.g., ethylene/alpha-olefin copolymers ("EAOs"), ethylene/unsaturated ester copolymers, and ethylene/(meth)acrylic acid), polypropylene homopolymers, polypropylene copolymers, polyvinyl chloride, various types of natural or synthetic rubber (e.g., styrene-butadiene rubber, polybutadiene, neoprene rubber, polyisoprene rubber, ethylene-propylene diene monomer (EPDM) rubber, polysiloxane, nitrile rubber, and butyl rubber), and polyurethane (i.e., any one or more of polyurethane, polyether polyurethane, polyester polyurethane, and polycarbonate polyurethane, any of which may be aliphatic and/or aromatic). The retention sheet may also comprise thermoplastic polyolefin elastomers (TPOs), which are two-component elastomer systems comprising an elastomer (such as EPDM) finely dispersed in a thermoplastic polyolefin (such as polypropylene or polyethylene). "Copolymer" as used in this application means a polymer derived from two or more types of monomers, and includes terpolymers, etc.

A retention sheet comprising polyolefin (e.g., polyethylene), polyvinyl chloride, and/or polyurethane may be useful for lightweight applications, for example, where a sheet thickness of from 2 to 4 mils may be desirable. A retention sheet comprising polyurethane may provide desirable elastomeric, puncture resistance, temperature resistance, and tackiness characteristics.

The retention sheet may comprise effective amounts of one or more of tackifiers, antiblocking agents, and slip agents—or may be essentially free of any of these components. Tackifiers, antiblocking agents, and slip agents, and their effective amounts, are known to those of ordinary skill in the art.

The retention sheet may be manufactured by thermoplastic film-forming processes known in the art (e.g., tubular or blown-film extrusion, coextrusion, extrusion coating, flat or cast film extrusion). A combination of these processes may also be employed.

At least one side of the retention sheet may be corona and/or plasma treated to change the surface energy of the sheet, for example, to increase the ability of the retention sheet to adhere to a panel or tray frame.

Films that may be useful as retention sheets are described in U.S. Pat. No. 6,913,147 issued Jul. 5, 2005 and entitled "Packaging Structure Having a Frame and Film," which is incorporated herein in its entirety by reference.

The retention sheets and tray sheets of any of the embodiments described herein may comprise any of the materials, thicknesses, compositions, and other characteristics as described herein with respect to retention sheet 18.

Tray

Tray 14 comprises tray frame 62 defining tray opening 64 and may comprise tray opening border 68 surrounding the tray opening 64. Tray sheet 66 is attached to the tray frame 62 and extends over (i.e., across) the tray opening 64. In the drawings, tray sheet 66 is shown completely covering tray opening 64; in alternative embodiments the tray sheet may extend over the tray opening and only partially cover the tray opening (not illustrated). Tray sheet 66 may be attached to tray frame 62, for example to tray opening border 68, by any of the ways described herein with respect to attaching the retention sheet 18 to the panel 16 of the retention frame 12. In the drawings, tray sheet 66 is shown attached to the tray frame 62 along tray frame attachment zone 67 comprising adhesive 30. As shown, attachment zone 67 is discontinuous or periodic, having attachment areas corresponding to the corner regions of the tray opening border 68 of tray frame 62. However, tray frame attachment zone 67 may extend continuously (not illustrated) to circumscribe or surround the entirety of tray opening 64. Tray opening 64 may be larger than the product 8 to be packaged, that is, large enough that absent the attached tray sheet, the packaged product 8 would pass through the tray opening.

The tray frame 62, and any of the tray frames of the various embodiments described herein, may comprises any of the materials, thicknesses, compositions, and other characteristics as set forth herein with respect to panel 16. Tray sheet 66, and any of the tray sheets of the various embodiments described herein, may comprise any of the materials, compositions, and polymers set forth herein with respect to retention sheet 18, and may have any thickness, properties, treatments, additives, and other characteristics (e.g., flexibility, elasticity, optics, strength, elastic recovery, transparency, load tear resistance, puncture resistance) as set forth herein with respect to retention sheet 18.

Tray 14 is configured for positioning between the retention sheet 18 and the remainder portion 24 of the retention frame to juxtapose the tray opening 64 with the panel opening 28. Such a configuration of tray 14 is illustrated, for example, in FIGS. 1-3, wherein the dimensions of tray 14 and arrangement of the tray opening 64 are such that when tray 14 is positioned between retention sheet 18 and the remainder portion 24, the tray opening 64 is capable of overlapping or aligning with the panel opening 28 while the tray frame is supported by, and within the periphery of, the remainder portion 24, for example, supported by, and within the periphery of, the central panel portion 42 and/or the panel opening border 46. Although not required for all embodiments, in the illustrated embodiment of FIGS. 1-5 the peripheral dimensions of tray 14 correspond to the peripheral dimensions of the central panel portion 42, and/or the panel opening border 46, extending along first, second, third, and fourth fold lines 22, 38, 50, and 56.

Tray Attached to Retention Frame

As shown in FIG. 4, packaging system 10 may be configured so that tray 14 is connected to retention frame 12 and in a lay-flat, coplanar arrangement. An edge of retention frame 12 may be connected to (i.e., detachably connected to) an edge of tray 14 so that retention frame 12 and tray 14 are substantially coplanar. In such configuration, for example, tray 14 may be connected to one of first or second flaps 22, 40. As illustrated, bottom edge 44 of second flap 40 is detachably connected along an edge of tray 14, for example by line of detachability 70. As used herein, a "line of detachability" or similar phrase may be a perforated, scored, slitted, or otherwise significantly weakened line so as to facilitate the hand separation or detachment of two portions, such as the tray from the retention frame, along the line of detachability. As illustrated, line of detachability 70 comprises through slits extending for the majority of its length, leaving relatively minor portions of the line intact to join the tray to the retention frame.

In a similar manner, a series of detachable trays and retentions frames may be detachably connected to each other (not illustrated). For example, a series of two trays and two frames may be detachably connected to each other in a lay-flat configuration.

Manufacture of the Packaging System

Figure 9:
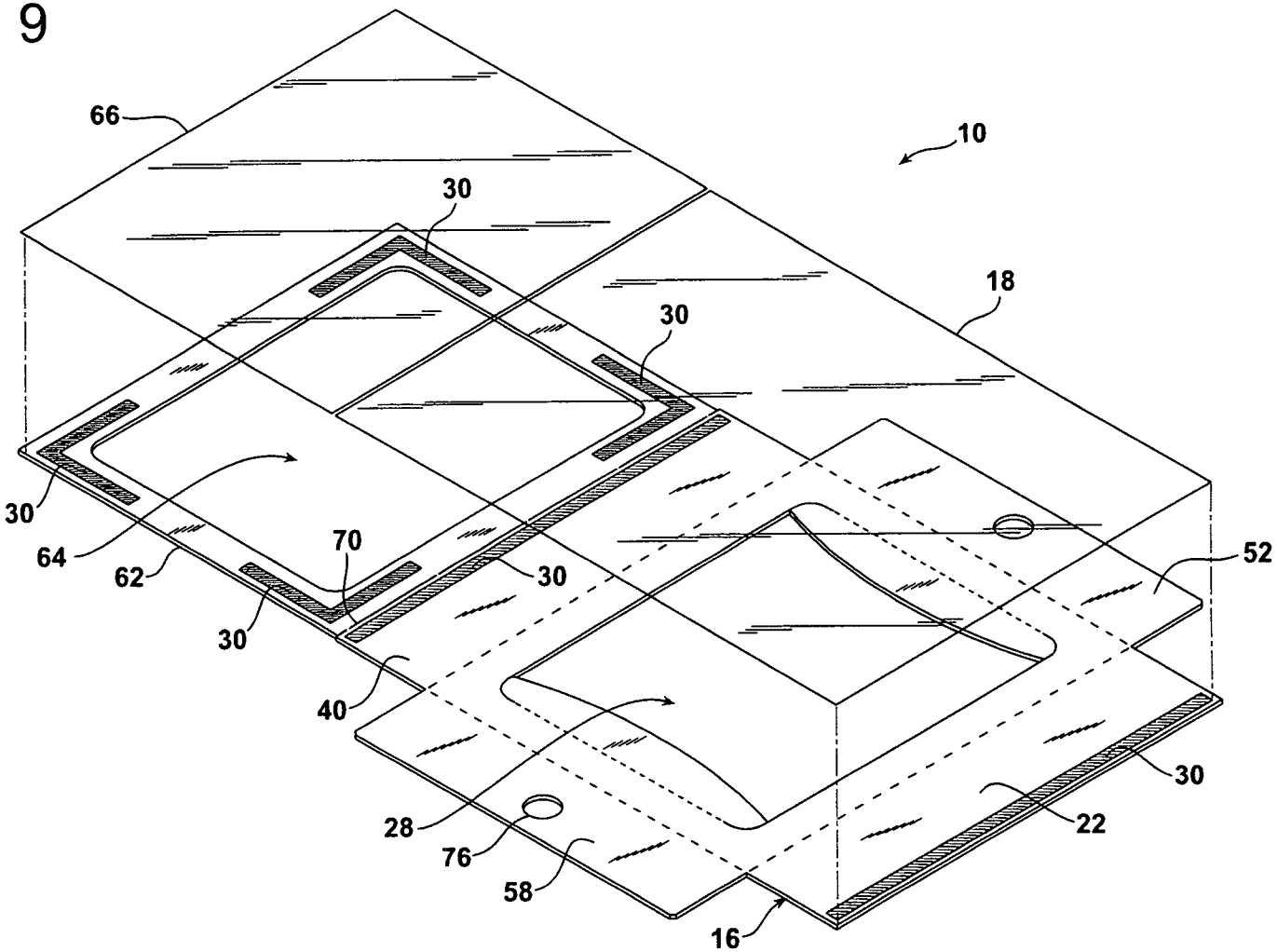
FIG. 9 is a representative perspective, exploded view of the packaging system 10 of FIG. 4.

By using types of machinery well known to those of skill in the field, the panel 16 and tray frame 62 may be cut to the desired shapes and provided with fold lines or lines of detachability, using the known types of machinery, for example, to slit, crease, crimp, emboss, perforate, scored, or otherwise weaken the panel and/or tray frame in desired regions. The adhesive 30 may be applied to the panel 16 and tray frame 62 in selected areas, for example, as shown in FIG. 9. The tray sheet 66 and retention sheet 18 may be laminated to the panel 16 and tray frame 62, respectively, by adhering the sheets with adhesive 30 to the panel or frame.

The tray sheet and retention sheet may be provided as separate sheets (as illustrated), for example, unrolled from two separate, side-by-side rolls and then cut to the desired length either before or after lamination. Alternatively, a single sheet (not illustrated) may be provided from a single roll and cut to the desired lengths and widths after lamination to the tray frame and panel to create the tray sheet and retention sheet after lamination. The tray sheet and retention sheet may be separated by a detachment line (not illustrated), corresponding to line of detachability 70, to facilitate separation of the sheets as the tray frame is detached from the panel.

Use of the Packaging System

In the use of the packaging system 10, the packaging system may be provided in the lay-flat configuration, as shown in FIG. 4, having the retention frame 12 and the tray 14 in a lay-flat, coplanar arrangement and in which the tray is detachably connected to retention frame 12 as discussed herein. Such configuration may facilitate the provision of multiple such packaging systems in a convenient stacked or bundled arrangement (not illustrated). The tray 14 may be detached from the retention frame 12, for example, by manually pulling apart these two elements along the line of detachment 70.

Figure 2:
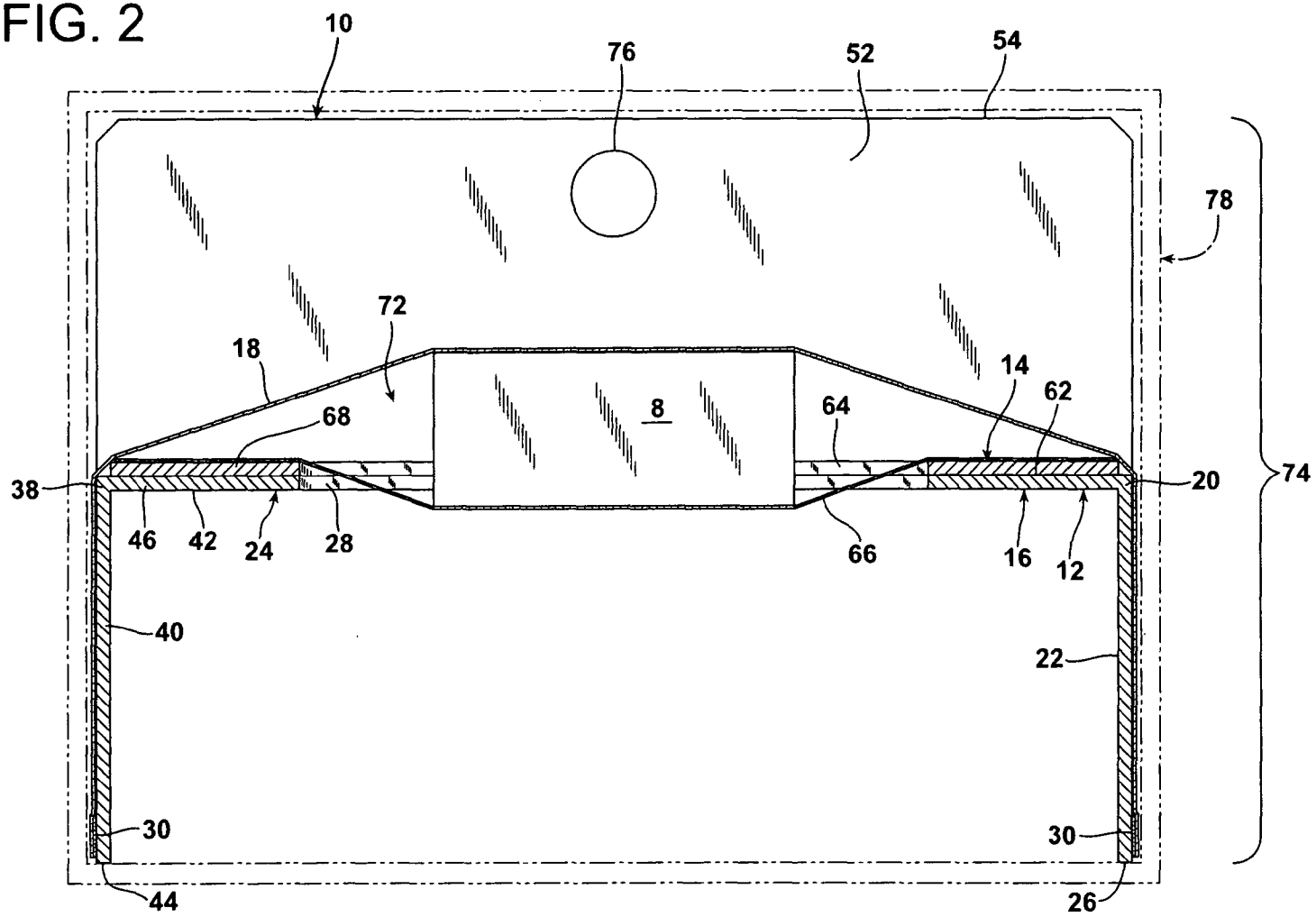
FIG. 2 is a representative side-view taken along line 2-2 of FIG. 1.
Figure 3:
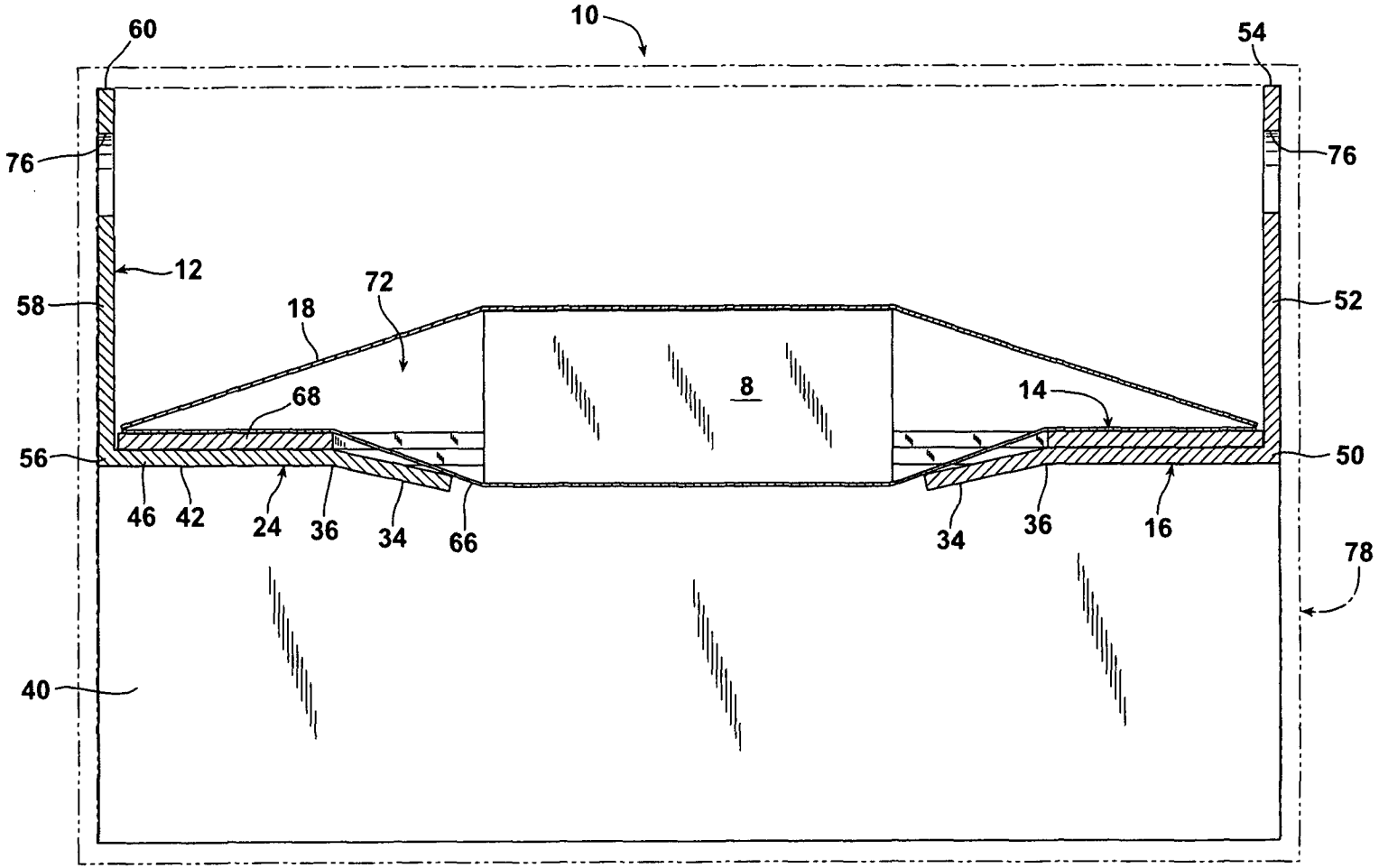
FIG. 3 is a representative side-view taken along line 3-3 of FIG. 1.
Figure 5:
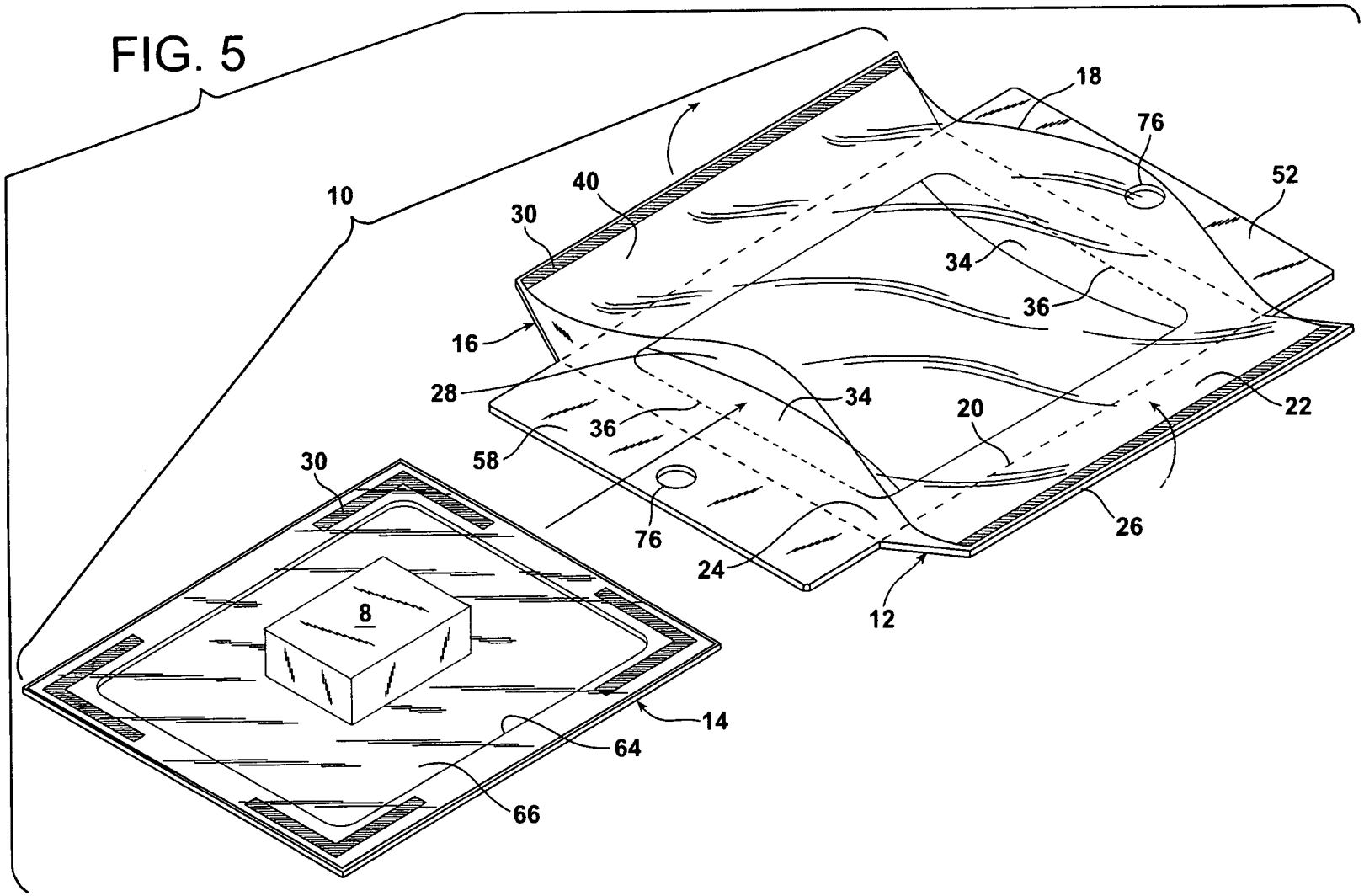
FIG. 5 is a representative perspective view of the packaging system 10 having the tray detached for installation with the frame.

Referring to FIG. 5, in use of packaging system 10, product 8 to be packaged may be placed on tray 14 so that the tray sheet 66 of tray 14 supports the product over the tray opening 64 and within the tray opening border 68. The first and second flaps 22, 40 of retention frame 12 may be lifted to extend upwardly from the lay-flat position and toward the retention sheet 18 over the panel opening 28 to create slack in the retention sheet. The tray 14 (supporting product 8) may be placed between retention sheet 18 and the remainder portion 24 of panel 16 to juxtapose tray opening 64 with panel opening 28. As shown in FIGS. 1-3, the tray opening border 68 may be supported by, and within the periphery of, the panel opening border 46. Product suspension space 72 is between the tray sheet 66 and the retention sheet 18, as well as aligned with (i.e., within or over) the juxtaposed tray opening and panel opening. The supported product 8 is in product suspension space 72 between retention sheet 18 and tray sheet 66.

After positioning tray 14 (supporting product 8) between the retention sheet 18 and remainder portion 24 of panel 16, as discussed above, the first and second flaps 22, 40 may be folded to a retention position, as illustrated in FIGS. 1-3, in which the flaps have been folded along first and second fold lines 20, 38 respectively, and downwardly from the retention sheet 18 to extend generally perpendicularly relative the central panel portion 42. In such position, the retention sheet 18 may be tensioned against product 8, which causes product 8 to press against the tray sheet 66, which upon equilibrium of the forces results in the suspension of product 8 in product suspension space 72 between the tray and retention sheets and aligned with (i.e., within or over) the juxtaposed tray and panel openings. The resulting retention forces encountered by product 8 may cause it to suspend within the juxtaposed tray opening 64 and panel opening 28, which may force tray sheet 66 to impinge against panel door portions 34 (FIG. 3) causing them to fold along panel door portion fold lines 36 while helping to support tray sheet 66 and thus help support suspended product 8.

As illustrated in FIGS. 1-3, the tray 14 is positioned between the retention sheet 18 and remainder portion 24 of panel 16 so that the tray sheet 66 is between the tray opening border 68 and the retention sheet 18. As an alternative (not illustrated in FIGS. 1-3), tray 14 may be positioned in a "flipped" orientation relative that shown in FIGS. 1-3, such that tray 14 is positioned between the retention sheet 18 and remainder portion 24 of panel 16 so that the tray sheet 66 is between the tray opening border 68 and the remainder portion 24 of panel 16.

First and second leg portions 52, 58 may be folded to a spacing position, as illustrated in FIGS. 1-3, in which the leg portions have been folded along third and fourth fold lines 50, 56 respectively, to extend in a direction opposite to the retention position of the first and second flaps. The retention frame height 74 is the summation of (i) the distance taken perpendicular to the plane of the central panel portion 42 and along the plane of the first leg portion 52 from the top surface of the central panel portion to the top edge 54 (i.e., the uppermost edge) of first leg portion 52 in the spacing position and (ii) the distance taken perpendicular to the plane of the central panel portion 42 and along the plane of the first flap 22 from the top surface of the central panel portion to the bottom edge 26 (i.e., the bottommost edge) of first flap 22 in the retention position.

Box

The packaging system 10 having the first and second flaps 22, 40 in the retention position and the first and second legs 52, 58 in the spacing position may be installed in box 78 to maintain the first and second flaps in the retention position and the first and second leg portions in the spacing position. (FIGS. 1-3.) The flaps in the retention position and the leg portions in the spacing position may have a tendency or bias to move back toward the pre-folded, lay-flat position, if unrestrained, due to the inherent characteristics of the material that the panel 16 is made. The walls of the box enclose the packaging system to prevent the movement of the flaps and leg portions past the walls, thereby restraining the flaps and leg portions to maintain them in the retention and spacing positions, respectively.

Box 78 has dimensions corresponding to packaging system 10 having retention flaps in the retention position and leg portions in the spacing position, so that box 78 is configured to enclose the packaging system to maintain the retention flaps and leg portions in the retention and spacing positions, respectively. For example, box 78 may have: (a) an interior length 80 corresponding to the distance between the first and second fold lines 20, 38 of the retention frame 12; (b) an interior width 82 corresponding to the distance between the third and fourth fold lines 50, 56 of the retention frame; and (c) an interior height 84 corresponding to the retention frame height 74.

Box 78 as illustrated comprises a polyhedron-shaped storage compartment, in which the side panels, bottom, and closure flaps are polygon-shaped (e.g., rectangular). Useful box types are known to those of skill in the field, and include containers of the RSC (regular slotted container) type, RELF (roll end lock front) type, RETT (roll and end tuck top) type, and STE (standard tuck end) type.

Additional Embodiments

Figure 6:
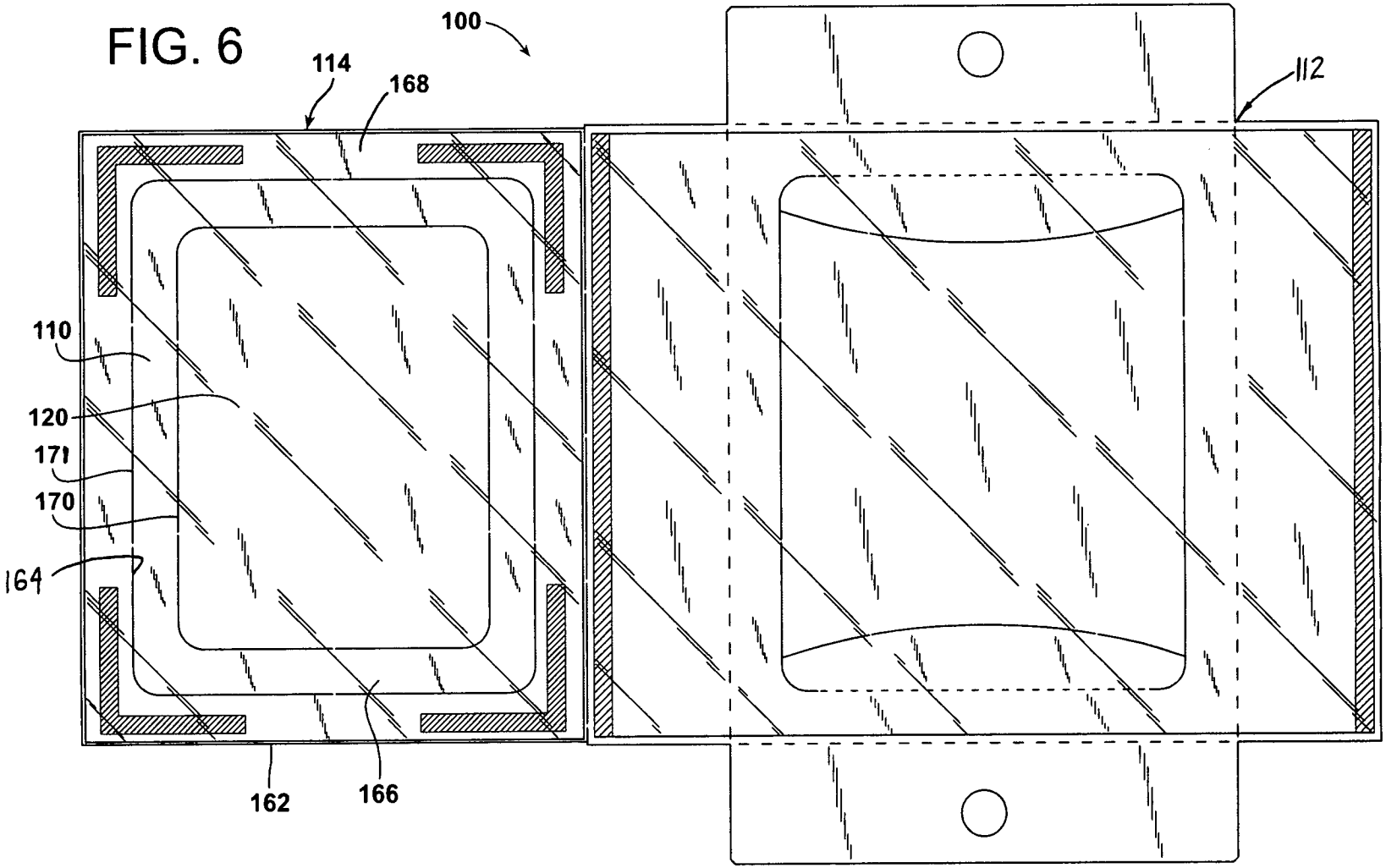
FIG. 6 is a representative top view of packaging system 100 in a lay-flat configuration.

Referring to FIG. 6, another embodiment is shown as packaging system 100 comprising retention frame 112 and tray 114, which are similar to packaging system 10 comprising retention frame 12 and tray 14 of FIGS. 1-5 in all aspects except that the tray 114 of packaging system 100 includes peripheral interior platform 110 and central interior platform 120 within tray opening 164. Peripheral interior platform 110 may be connected to (i.e., detachably connected to) both tray opening border 168 and to central interior platform 120 so that platforms 110, 120 and tray frame 162 are substantially coplanar, having peripheral interior platform 110 and central interior platform 120 within the tray opening 164. As illustrated, the detachable connections are made by an outer line of detachability 171, which defines the perimeter of tray opening 164, and by inner line of detachability 170.

Platforms 110, 120 may be made of any of the materials from which the tray frame is made. Platforms 110, 120 may provide additional support to a product supported by the tray sheet 166. For example, if a product is supported by the tray sheet 166 by placing the product directly on platform 120, then the platform 120 may be shaped with cutouts (not illustrated) corresponding to the shape of the product to help restrict the lateral movement of the product on the sheet. In use, once the tray 114 with supported product is installed in a corresponding retention frame that is subsequently placed in the retention position, the applied retention forces may cause the peripheral panel 110 and the central panel 120 to detach partially and/or completely from each other and the tray opening border 168.

Figure 7:
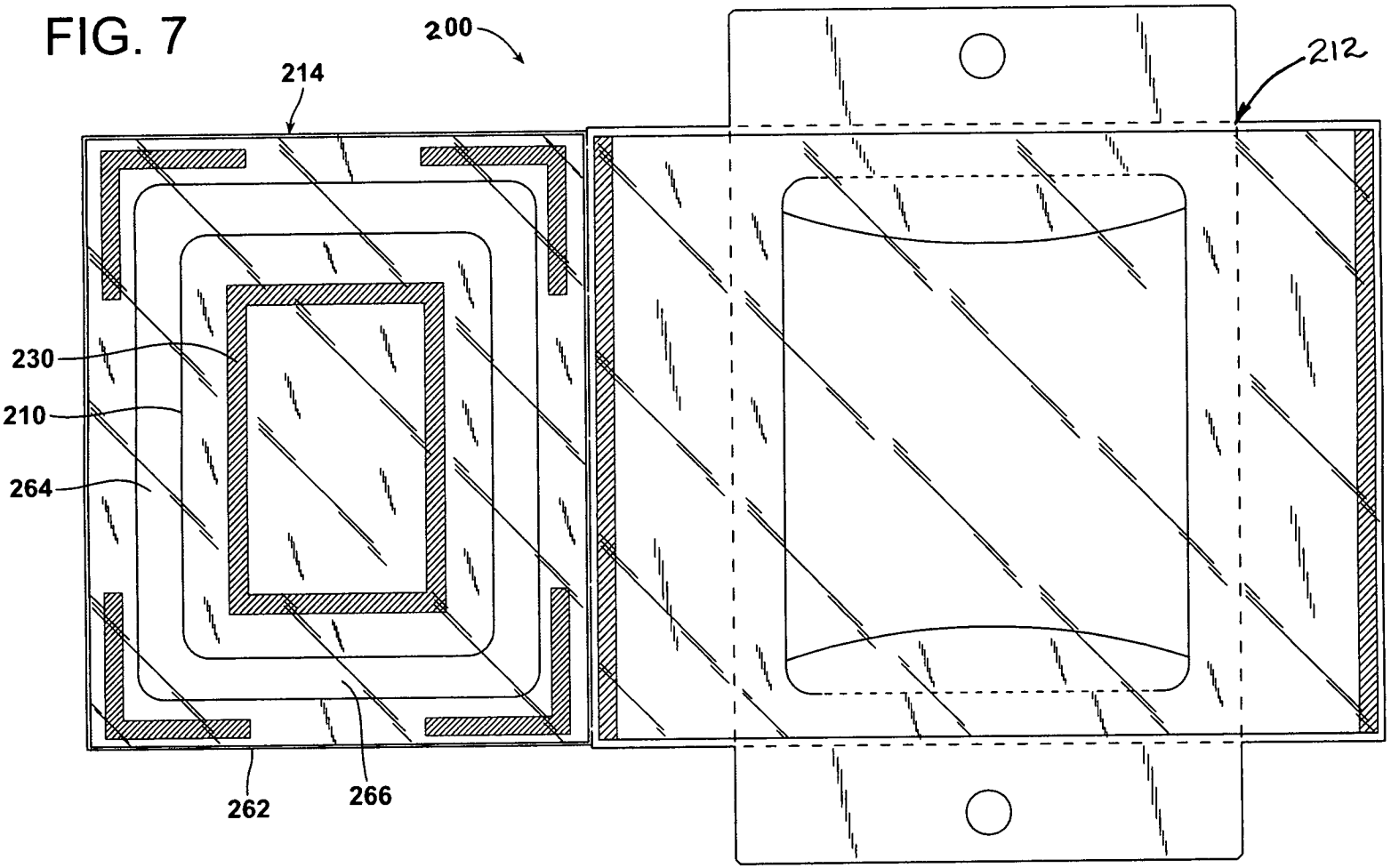
FIG. 7 is a representative top view of packaging system 200 in a lay-flat configuration.

Referring to FIG. 7, another embodiment is shown as packaging system 200 comprising retention frame 212 and tray 214, which are similar to packaging system 10 comprising retention frame 12 and tray 14 of FIGS. 1-5 in all aspects except that the tray 214 of packaging system 200 also includes center platform 210 attached to tray sheet 266 within tray opening 264. Platform 210 may be dimensioned so that it does not touch tray frame 262. Center platform 210 may be made of any of the materials from which the tray frame is made, and may be attached to the tray sheet using any of the sheet attachments ways described herein, for example, adhering by adhesive attachment using adhesive 230. Center platform 210 may function to provide additional support to a product supported by the tray sheet 266. For example, if the product is supported by the tray sheet 266 by placing the product directly on center platform 210, then the platform 210 may be shaped with cutouts (not illustrated) corresponding to the shape of the product to help restrict the lateral movement of the product on the sheet.

Figure 8:
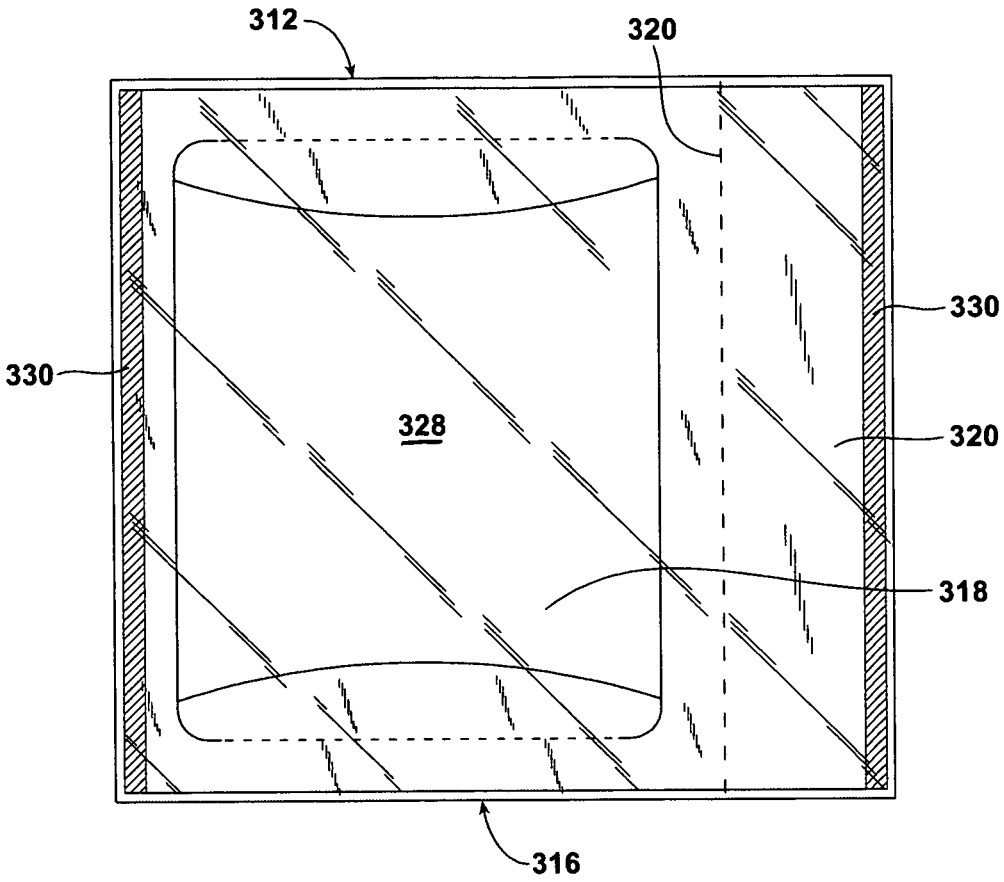
FIG. 8 is a representative top view of retention frame 312 in a lay-flat configuration.

Referring to FIG. 8, another embodiment of the retention frame is shown as retention frame 312, similar to retention frame 12 of FIGS. 1-5 in all aspects except that retention frame 312 lacks a second flap and any leg portions. Retention frame 312 comprises panel 316 having first fold line 320 defining first flap 322 and remainder portion 324 defining panel opening 328. Retention sheet 318 is attached (e.g., by adhesive 330) to first flap and to the remainder portion, and extends over the panel opening and first fold line.

Figure 23:
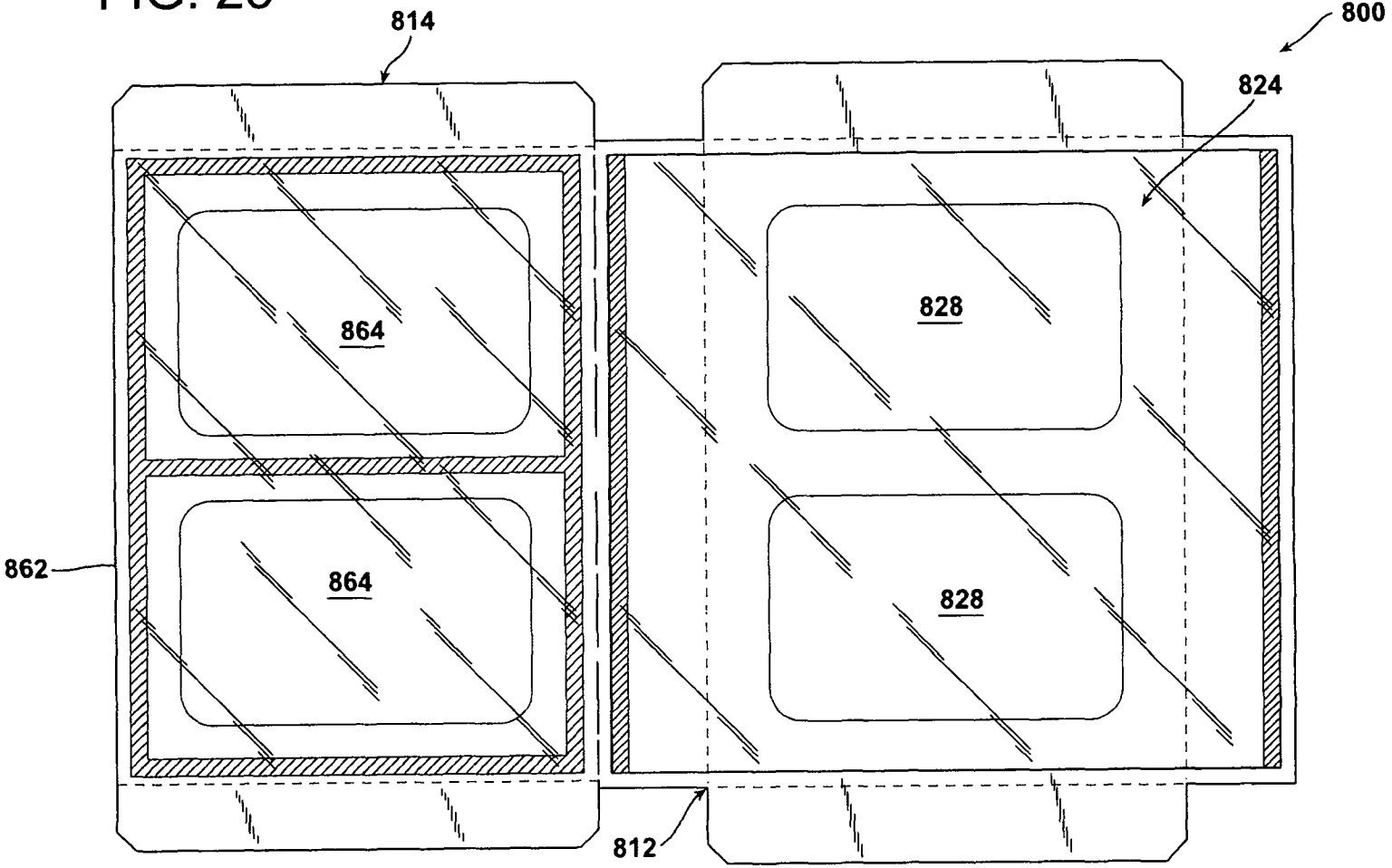
FIG. 23 is a representative top view of packaging system 800 in a lay-flat configuration.

Referring to FIG. 23, another embodiment is shown as packaging system 800, illustrating that retention frame 800 comprising remainder portion 824 may define a plurality of panel openings 828. Tray 814 comprising tray frame 862 may defining a plurality of tray openings 864. The tray openings may be configured so that each tray opening corresponds with a panel opening of the retention frame, so that each tray opening may be juxtaposed with a corresponding panel opening when the tray is positioned and installed between the retention sheet and the remainder portion of the retention frame. As such, packaging system 800 may be configured for packaging multiple products. Companion panel openings do not have to be the same size, nor do companion tray openings have to be the same size, so that products having different shapes may be packaged within the same system.

Figure 10:
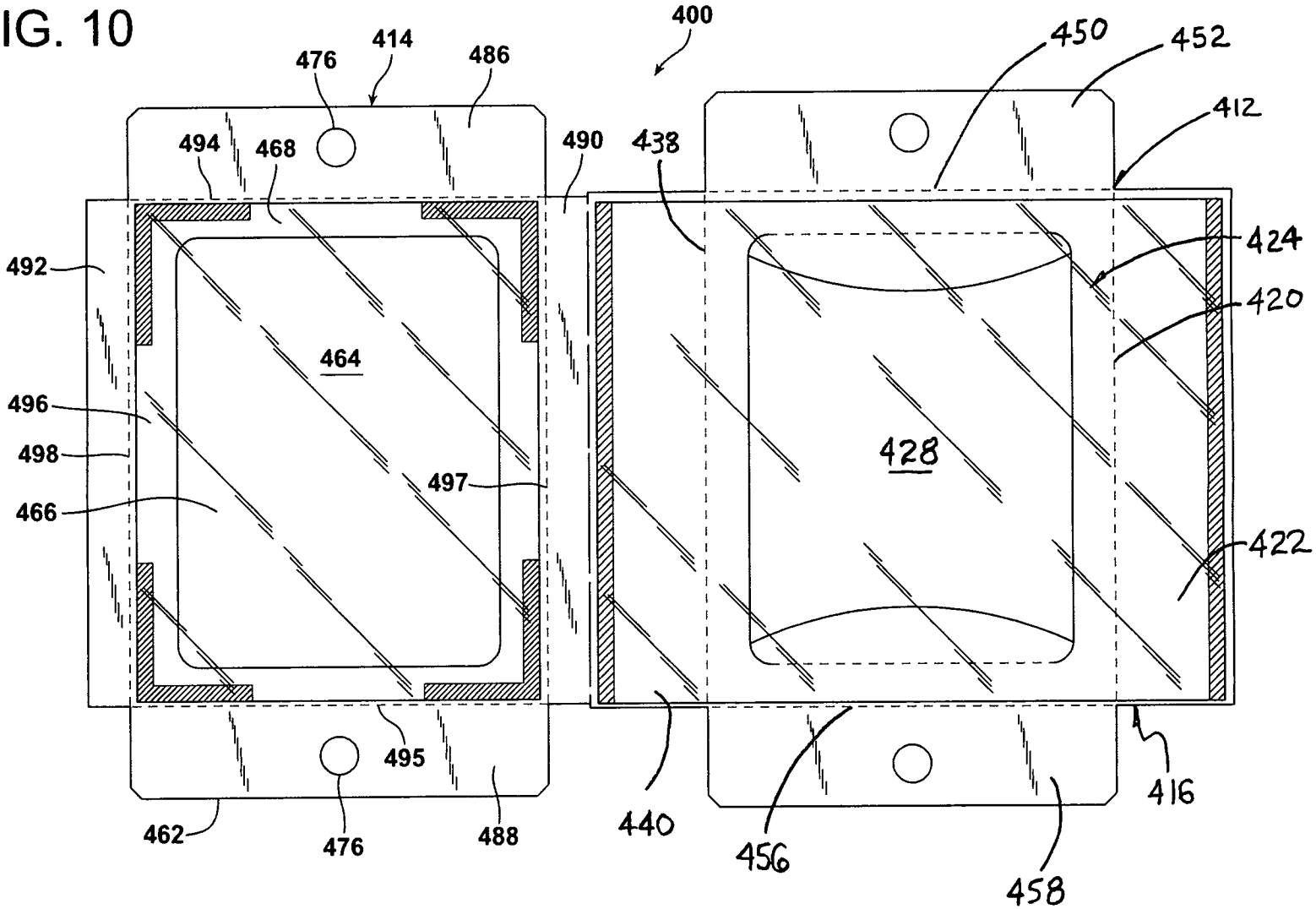
FIG. 10 is a representative top view of packaging system 400 in a lay-flat configuration.
Figure 11:
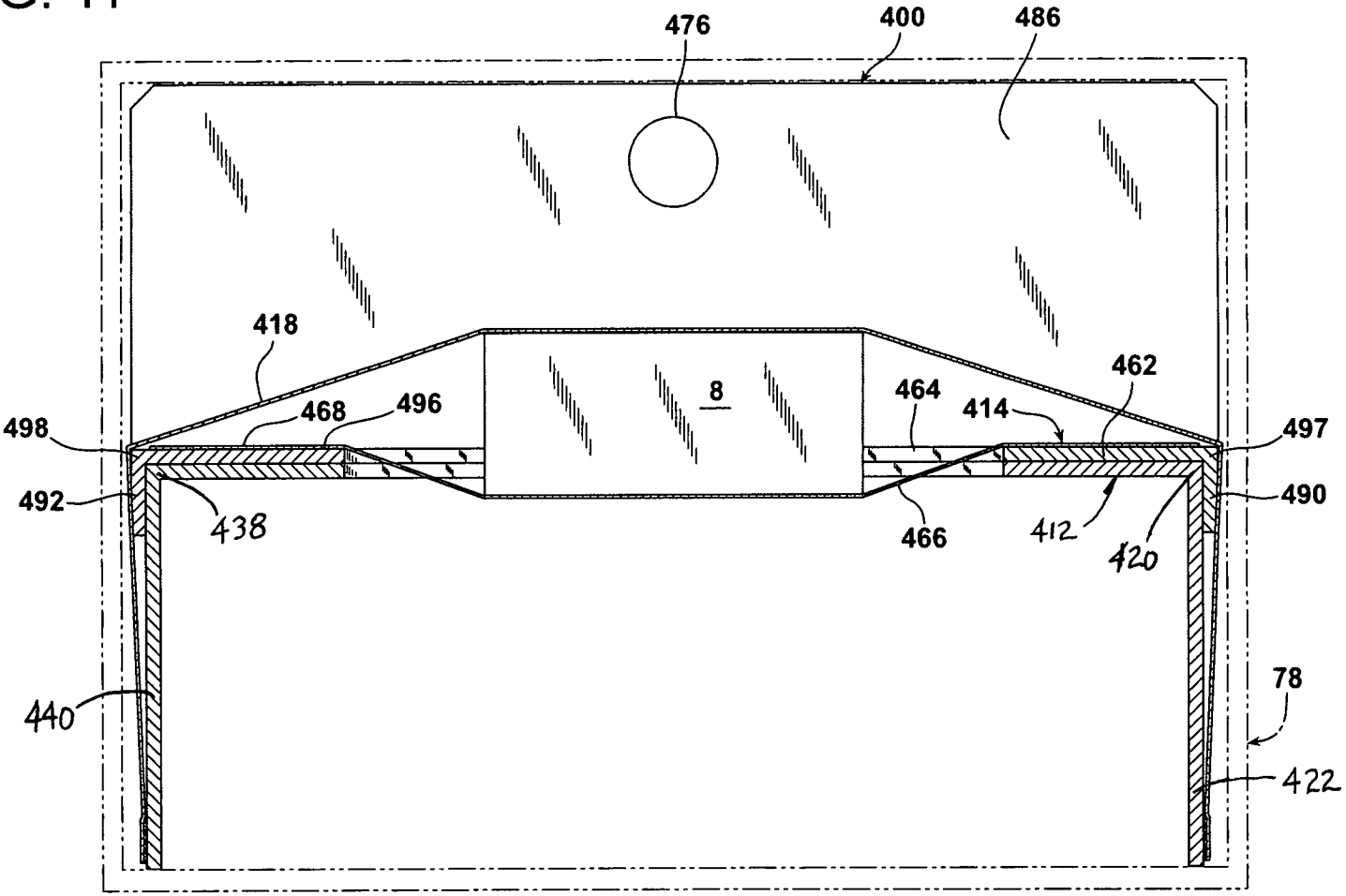
FIG. 11 is a representative sectional side view of packaging system 400 installed in box 78 and suspending product 8.
Figure 12:
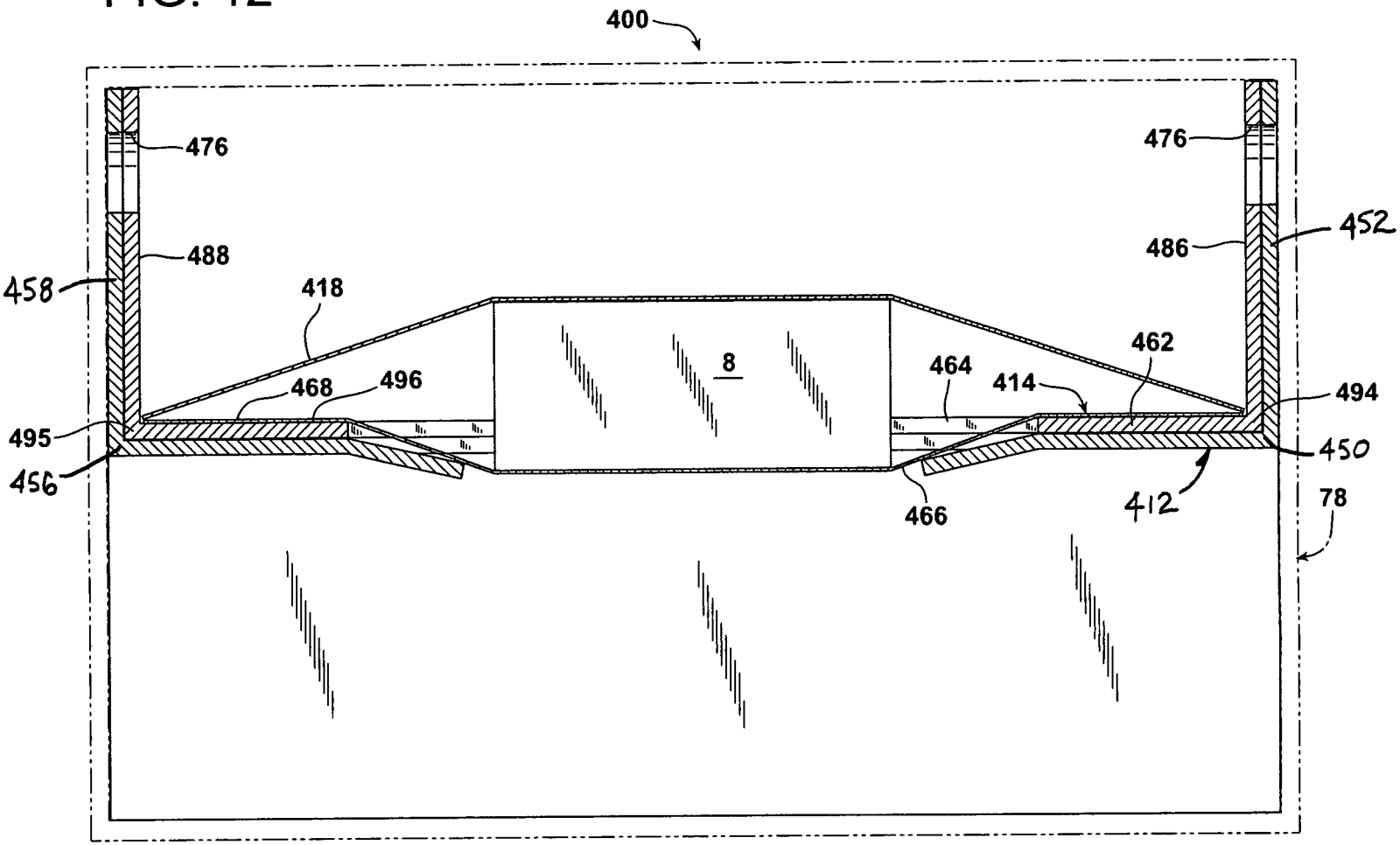
FIG. 12 is another representative sectional side view of packaging system 400 installed in box 78 and suspending product 8.

Embodiment of FIGS. 10-12

Referring to FIGS. 10-12, another embodiment is shown as packaging system 400 comprising retention frame 412 and tray 414, which are similar to packaging system 10 comprising retention frame 12 and tray 14 of FIGS. 1-5 (FIG. 10 similar to the view of FIG. 4, FIG. 11 similar to the view of FIG. 2, and FIG. 12 similar to the view of FIG. 3) in all aspects except that tray 414 of packaging system 400 further comprises first and second tray leg portions 486, 488 and first and second reinforcement portions 490, 492. Tray 414 comprises tray frame 462 defining tray opening 464 and may comprise tray opening border 468 surrounding the tray opening 464. Tray sheet 466 is attached to the tray frame 462 and extends over (i.e., across) the tray opening 464.

Tray frame 462 has a first tray leg fold line 494 and second tray leg fold line 495 that define, or separate tray frame 462 into, first tray leg portion 486 and second tray leg portion 488, respectively, extending in opposite directions from central tray portion 496 between the first fold line 494 and second fold line 495. Central tray portion 496 defines tray opening 464 and comprises tray opening border 468 surrounding tray opening 464. The first and second fold lines 494, 495 may be generally parallel to each other, and on opposite sides of the tray opening. The first and second tray legs are foldably connected to the central tray portion along the first and second tray leg fold lines, respectively. The first and second tray leg portions may define finger hold 476.

Tray frame 462 has first reinforcement portion fold line 497 and second reinforcement portion fold line 498 that define, or separate tray frame 462 into, first reinforcement portion 490 and second reinforcement portion 492, respectively, extending in opposite directions from central tray portion 496 between the first reinforcement portion fold line 497 and second reinforcement portion fold line 498. The first and second reinforcement fold lines 497, 498 may be generally parallel to each other, and on opposite sides of the tray opening. The first and second reinforcement portions are foldably connected to the central tray portion along the third and fourth fold lines 497, 498, respectively.

Either or both of the third fold line 497 and the fourth fold line 498 may be generally perpendicular to either or both of the first fold line 494 and the second fold line 495. The first, second, third, and fourth fold lines (494, 495, 497, 498) may collectively bound (e.g., circumscribe) central tray portion 496.

In use of the packaging system 400 having tray 414 installed between the retention sheet and the remainder portion 424 of the retention frame 412, the first and second reinforcement portion fold lines 497 and 498 may be oriented on tray frame 462 so that upon juxtaposing the tray opening 464 of tray 414 with the panel opening 428 of retention frame 412, the first reinforcement portion fold line 497 may be aligned with the first fold line 420 of the panel 416; and the second reinforcement portion fold line 498 may be aligned with the second fold line 438 of the remainder portion 424 of retention panel 416. (FIG. 11.) As the first and second retention flaps 422, 440 of the retention frame are placed in the retention position, the first and second reinforcement portions 490, 492 of tray 414 are folded along first and second reinforcement portion fold lines 497, 498, respectively, and may provide reinforcement strength to the frame flaps. (FIG. 11.)

In use of the packaging system 400 having tray 414 installed between the retention sheet and the remainder portion 424 of the retention frame 412, the first and second tray leg fold lines 494 and 495 may be oriented on tray frame 462 so that upon juxtaposing the tray opening 464 of tray 414 with the panel opening 428 of retention frame 412, the first tray leg fold line 494 may be aligned with the third fold line 450 of the remainder portion 424 of retention panel 416; and the second tray leg fold line 495 may be aligned with the fourth fold line 456 of the remainder portion 424 of retention panel 416. (FIG. 12.) As the first and second leg portions 452, 458 of the retention frame are placed in the spacing position, the first and second tray leg portions 486, 488 are folded along fold lines 494, 495, respectively, and may provide reinforcement strength to the adjacent frame leg portions. (FIG. 12.)

Figure 13:
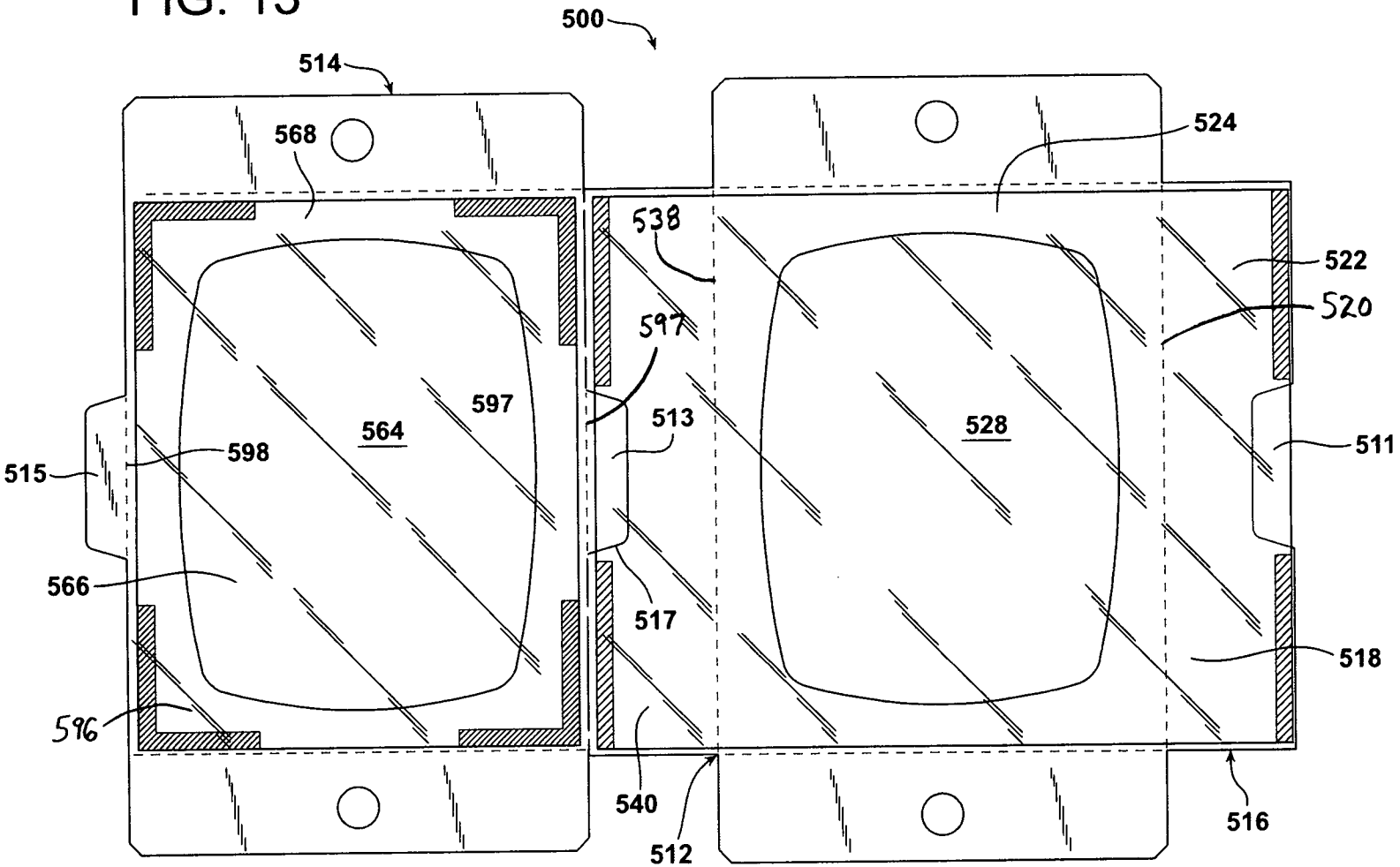
FIG. 13 is a representative top view of packaging system 500 in a lay-flat configuration.
Figure 14:
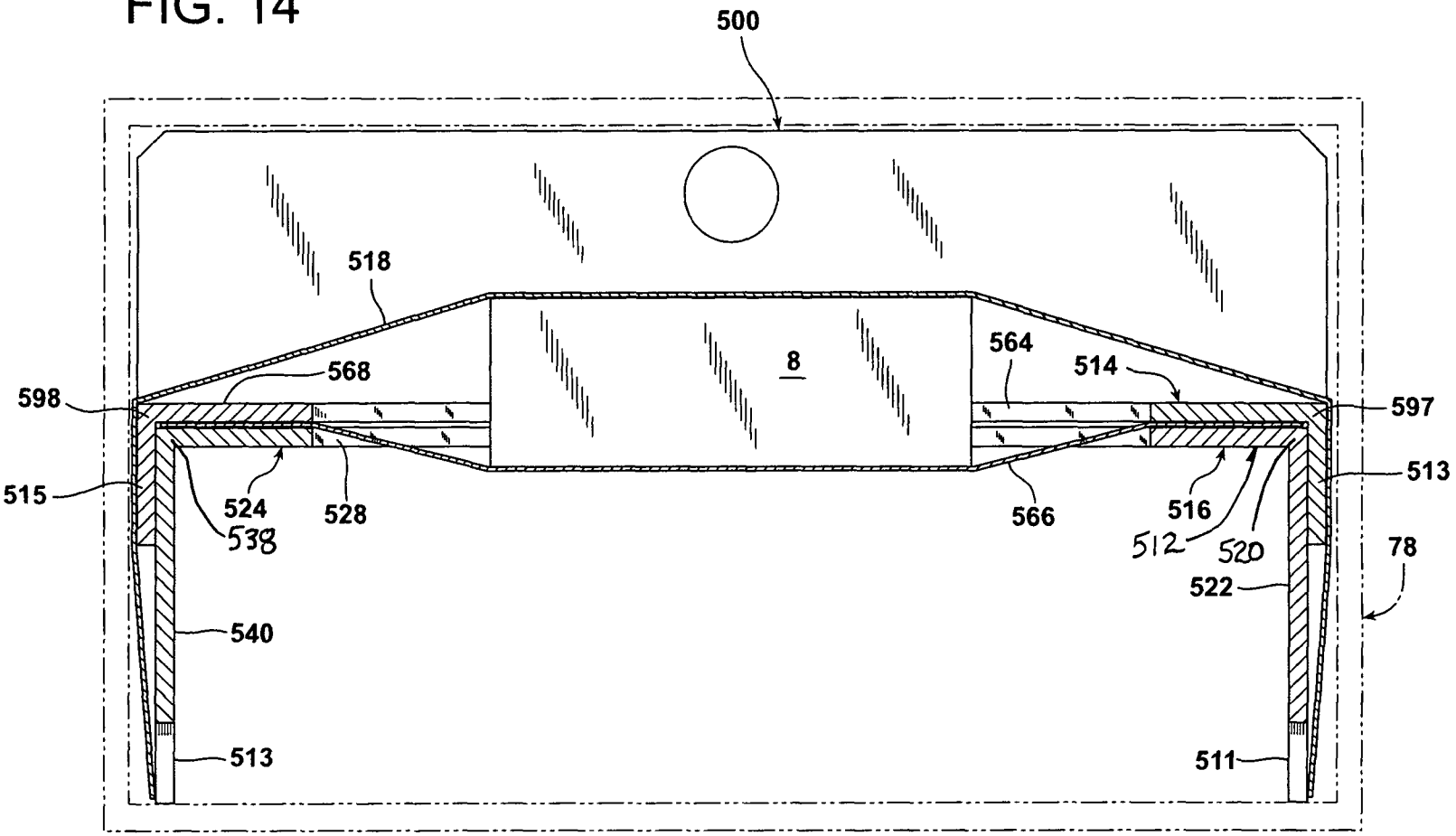
FIG. 14 is a representative sectional side view of packaging system 500 installed in box 78 and suspending product 8.
Figure 15:
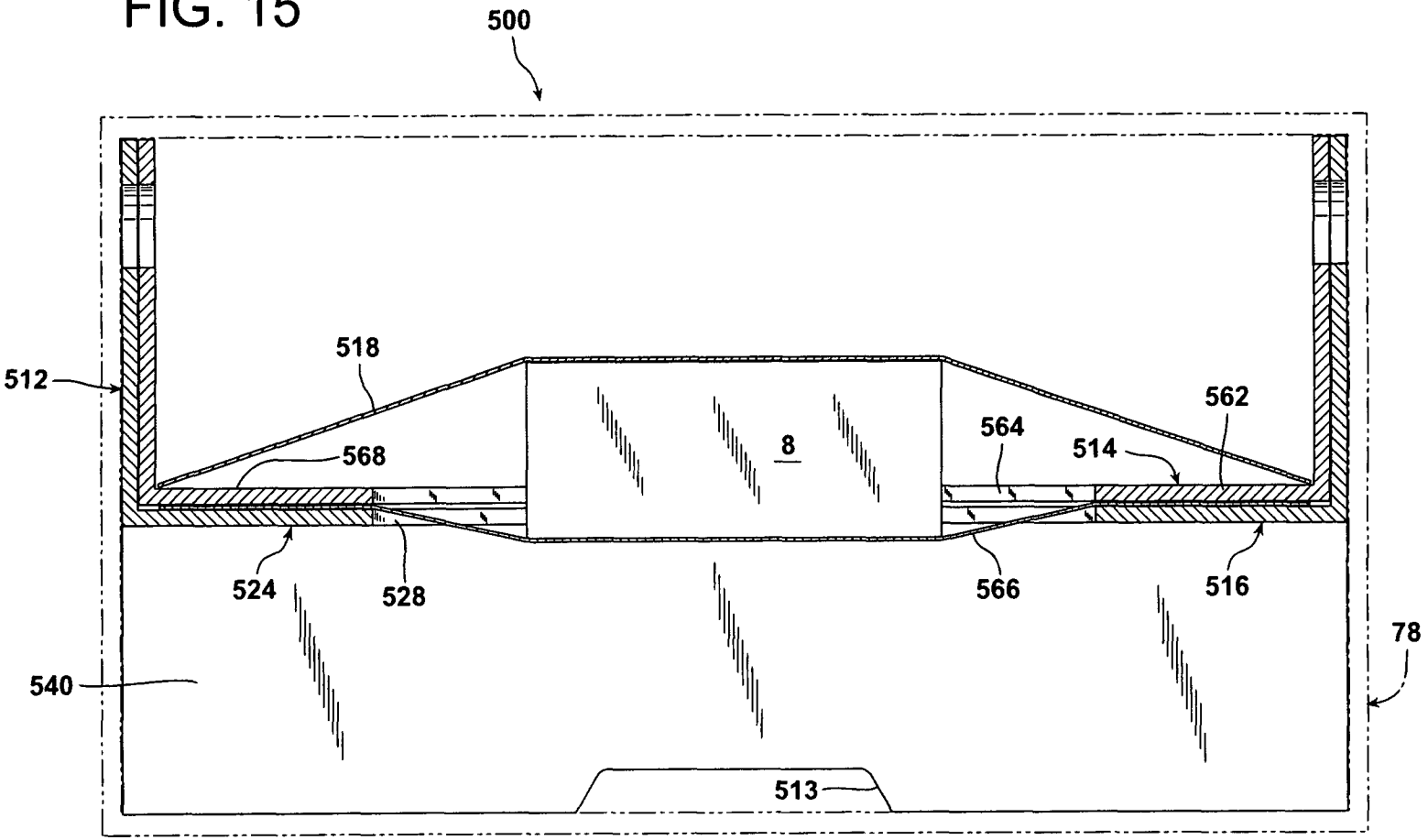
FIG. 15 is another representative sectional side view of packaging system 500 installed in box 78 and suspending product 8.

Embodiment of FIGS. 13-15

Referring to FIGS. 13-15, another embodiment is shown as packaging system 500, similar to packaging system 400 of FIGS. 10-12 (FIG. 13 being similar to the view of FIG. 10, FIG. 14 being similar to the view of FIG. 11, and FIG. 15 being similar to the view of FIG. 12) in all aspects except as noted herein. First, the panel opening 528 defined by remainder portion 524 of retention frame 512 has an arched configuration. Further, the retention frame 512 does not include door portions extending into the panel opening 528. The first flap 522 of retention frame 512 defines notch 511, complementary to the shape of tab 515 of tray 514. The second flap 540 defines notch 517, complementary to the shape of tab 513 of tray 514. Tray 514 includes first and second tab portions 513, 515, which correspond in orientation and function to the first and second reinforcement portions of tray 414 of packaging system 400. First tab portion 513 extends from tray opening border 568 and is foldably connected thereto by first tab fold line 597. Second tab portion 515 extends from tray opening border 568 and is foldably connected thereto by second tab fold line 598. The first and second tab portions extend in opposite directions from central tray portion 596 and from the tray opening border 568 between the first tab fold line 597 and the second tab fold line 598. The first and second tab fold lines 497, 498 may be generally parallel to each other, and on opposite sides of the tray opening. First and second tab portions 513, 515 function similarly to the first and second reinforcement portions 490, 492 of packaging system 400, providing reinforcement strength to the central portion of adjacent frame leg portions, but using less material. The length of the first tab portion taken along the first tab fold line (and/or the length of the first tab fold line itself) and the length of the second tab portion taken along the second tab fold line (and/or the length of the second tab fold line itself) are each less than the corresponding length of the central panel portion. The tray opening 564 has an arched shape generally corresponding to the panel opening 528.

In use of the packaging system 500 having tray 514 installed between the retention sheet 518 and the remainder portion 524 of the retention frame 512, the first and second tab fold lines 597 and 598 may be oriented on tray frame 562 so that upon juxtaposing the tray opening 564 of tray 514 with the panel opening 528 of retention frame 512, the first tab fold line 597 may be aligned with the first fold line 520 of the panel 516; and the second tab fold line 598 may be aligned with the second fold line 538 of the remainder portion 524 of retention panel 516. (FIG. 14.) As the first and second retention flaps 522, 540 of the retention frame are placed in the retention position, the first and second tab portions 513, 515 of tray 514 are folded along first and second tab fold lines 597, 598, respectively, and may provide reinforcement strength to the frame flaps. (FIG. 14.) As shown in FIGS. 14 and 15, the tray 514 is installed in a "flipped" orientation relative to that shown for tray 414 in FIGS. 11 and 12, such that tray 514 is positioned between the retention sheet 518 and remainder portion 524 of panel 516 so that the tray sheet 566 is between the tray opening border 568 and the remainder portion 524 of panel 516.

Embodiment of FIGS. 16-19

Figure 16:
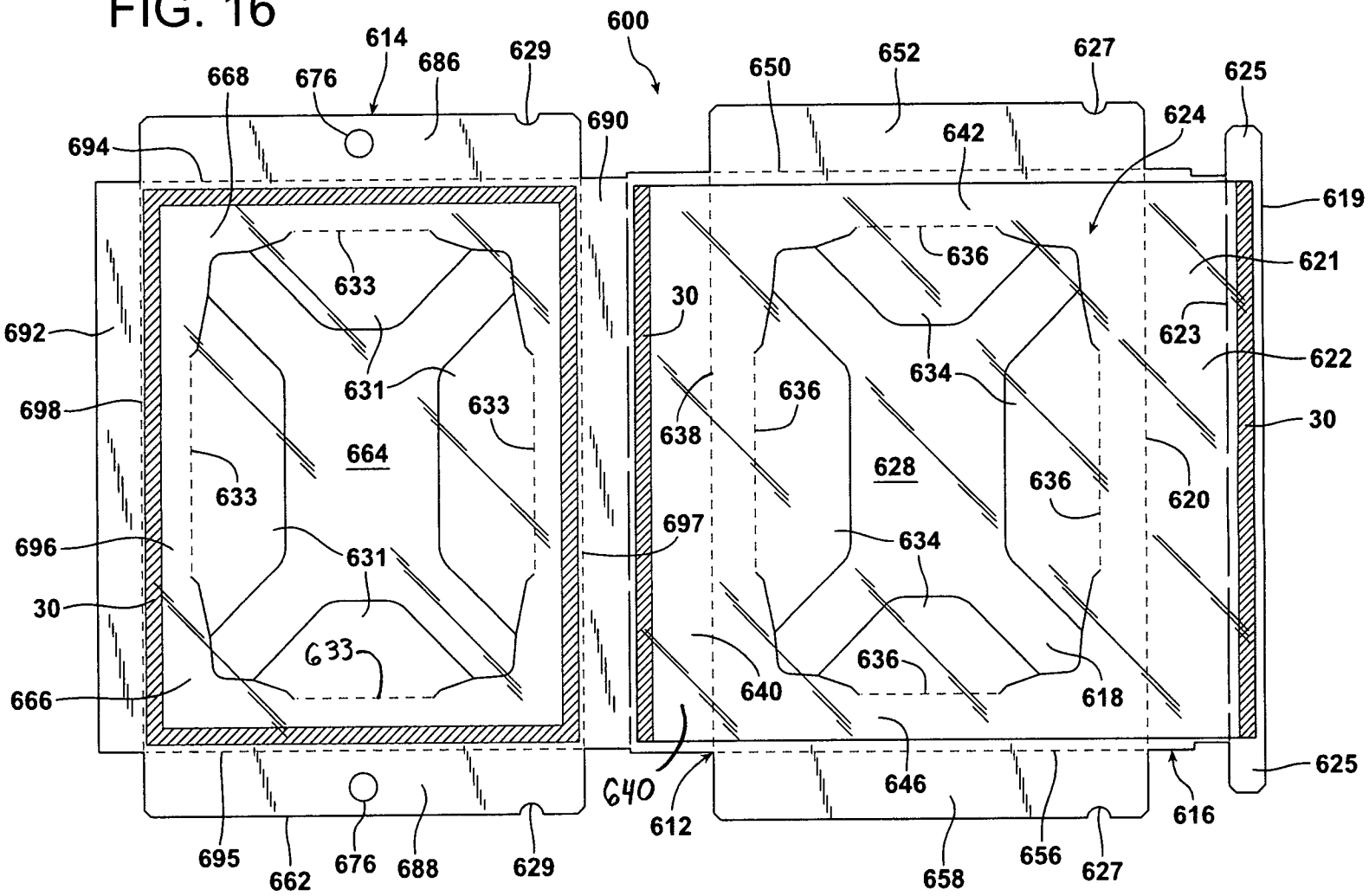
FIG. 16 is a representative top view of packaging system 600 in a lay-flat configuration.

Referring to FIGS. 16-19, another embodiment is shown as packaging system 600. Retention frame 612 comprises panel 616 and retention sheet 618. Panel 616 has a first fold line 620 that defines, or separates panel 616 into, first flap 622 and remainder portion 624. Remainder portion 624 defines panel opening 628. The panel 616 may comprise one or more panel door portions 634 extending into the panel opening 628 and foldably connected to the remainder portion 624 along one or more corresponding panel door fold lines 636. As such, the perimeter of panel opening 628 may be defined at least in part by the one or more panel door portion fold lines 636. The panel may comprise one or more pairs of opposing panel door portions 634, as illustrated in FIG. 16, showing panel 616 comprising two pairs of opposing panel door portions 634.

First flap 622 has flap line of detachability 623, which may be generally parallel to the first fold line 620, defining breakaway piece 619 and flap main portion 621. Breakaway piece 619 comprises tabs 625 extending laterally relative the flap main portion 621. Retention sheet 618 is attached to the breakaway piece 619 of first flap 622 and extends over (i.e., across) the flap line of detachability 623, the first fold line 620, and panel opening 628—and is attached to remainder portion 624. In the drawings, retention sheet 618 is shown attached to the first flap 622 and the remainder portion 624 by adhering with adhesive 30; however, the retention sheet may be attached to first flap and remainder portion by one or more of any of the way described herein.

Remainder portion 624 of panel 616 has second fold line 638 that defines, or separates remainder portion 624 into, second flap 640 and central panel portion 642. Central panel portion 642 is between the first fold line 620 and second fold line 638. Central panel portion 642 defines the panel opening 628 and may comprise panel opening border 646 surrounding the panel opening 628.

The retention sheet 618 is attached to second flap 640 of remainder portion 624 and extends over the second fold line 638. Retention sheet 618 may be attached to the second flap 640 by adhering with adhesive 30.

The remainder portion 624 may have a third fold line 650 that defines, or separates remainder portion 624 into, a first leg portion 652 extending from the central panel portion 642. The remainder portion 624 may have a fourth fold line 656 that defines, or separates remainder portion 624 into, a second leg portion 658 extending from the central panel portion 642. The central panel portion 642 is between the third and fourth fold lines 650, 656. The first, second, third, and fourth fold lines (620, 638, 650, 656) may collectively bound (e.g., circumscribe) central panel portion 642 of the remainder portion 624. The first and second leg portions 652, 658 may define finger notches 627, useful for aligning the frame with the tray during installation.

Tray 614 comprises tray frame 662 defining tray opening 664 and tray opening border 668 surrounding the tray opening 664. One or more tray door portions 631 may extend into the tray opening 664 and be foldably connected to the tray opening border 668 along one or more corresponding tray door portion fold lines 633. As such, the perimeter of tray opening 664 may be defined at least in part by the one or more tray door portion fold lines 633. The tray may comprise one or more pairs of opposing tray door portions 631, as illustrated in FIG. 16.

Tray sheet 666 is attached to the tray frame 662 and extends over (i.e., across) the tray opening 664. Tray sheet 666 may be attached to tray frame 662 by adhesive 30. As shown, the adhesive 30 extends continuously to circumscribe or surround the entirety of tray opening 664. Tray 614 is configured for positioning between the retention sheet 618 and the remainder portion 624 of the retention frame to juxtapose the tray opening 664 with the panel opening 628.

Tray 614 comprises first and second tray leg portions 686, 688 and first and second reinforcement portions 690, 692. Tray frame 662 has a first fold line 694 and second fold line 695 that define, or separate tray frame 662 into, first tray leg portion 686 and second tray leg portion 688, respectively, extending from central tray portion 696 between the first fold line 694 and second fold line 695. Central tray portion 696 of tray frame 662 defines tray opening 664 and comprises tray opening border 668 surrounding tray opening 664. The first and second fold lines 694, 695 may be generally parallel to each other, and on opposite sides of the tray opening. The first and second tray leg portions may define finger hold 676 and notches 629 to correspond with the notches 627 of the retention frame in the installed configuration.

Tray frame 662 also has third fold line 697 and fourth fold line 698 that define, or separate tray frame 662 into, first reinforcement portion 690 and second reinforcement portion 692, respectively, extending from central tray portion 696 between the third fold line 697 and fourth fold line 698. The third and fourth fold lines 697, 698 may be generally parallel to each other, and on opposite sides of the tray opening.

Either or both of the third fold line 697 and the fourth fold line 698 may be generally perpendicular to either or both of the first fold line 694 and the second fold line 695. The first, second, third, and fourth fold lines (694, 695, 697, 698) may collectively bound (e.g., circumscribe) central tray portion 696.

Figure 17:
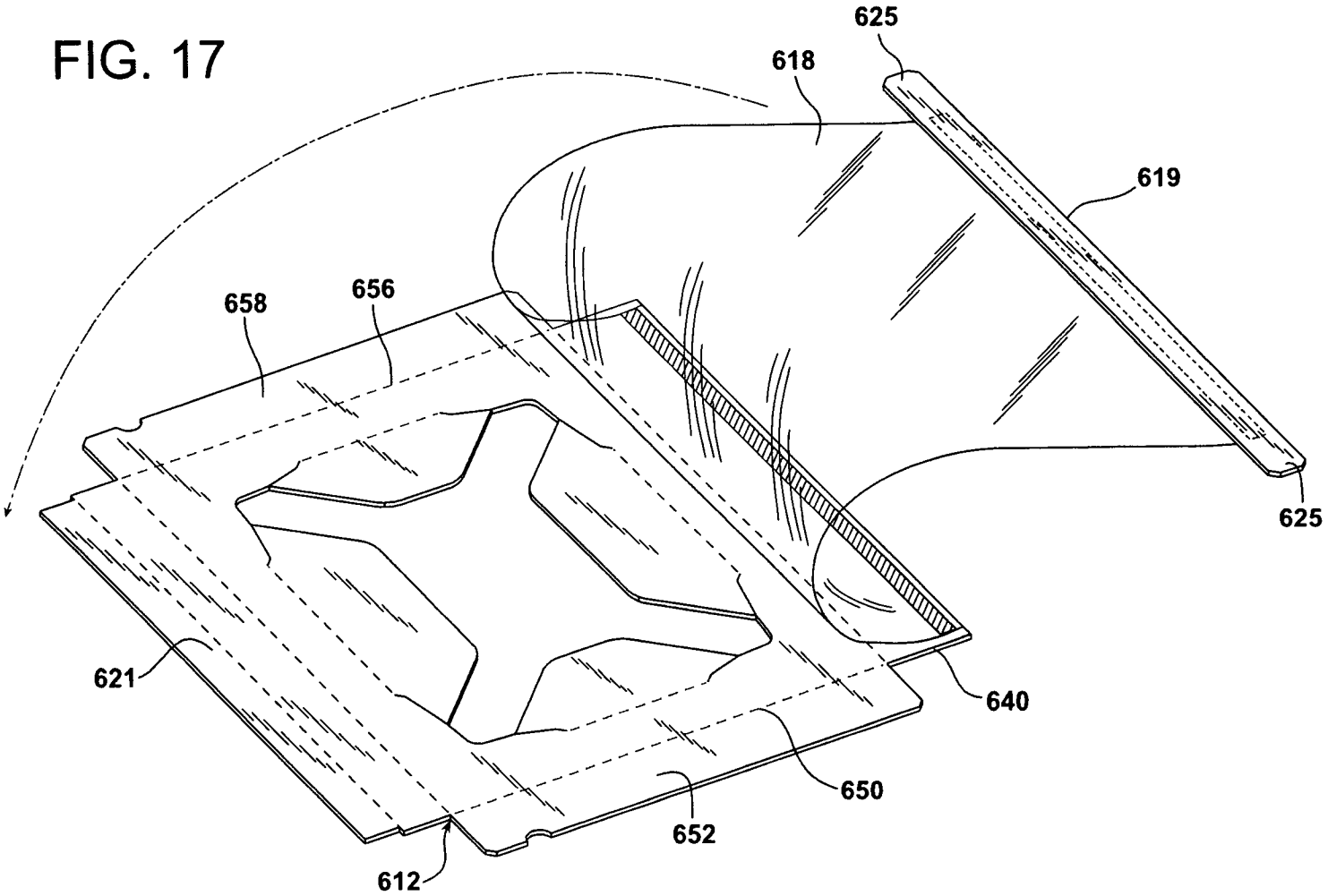
FIG. 17 is a representative perspective view of the retention frame 612 of packaging system 600.
Figure 18:
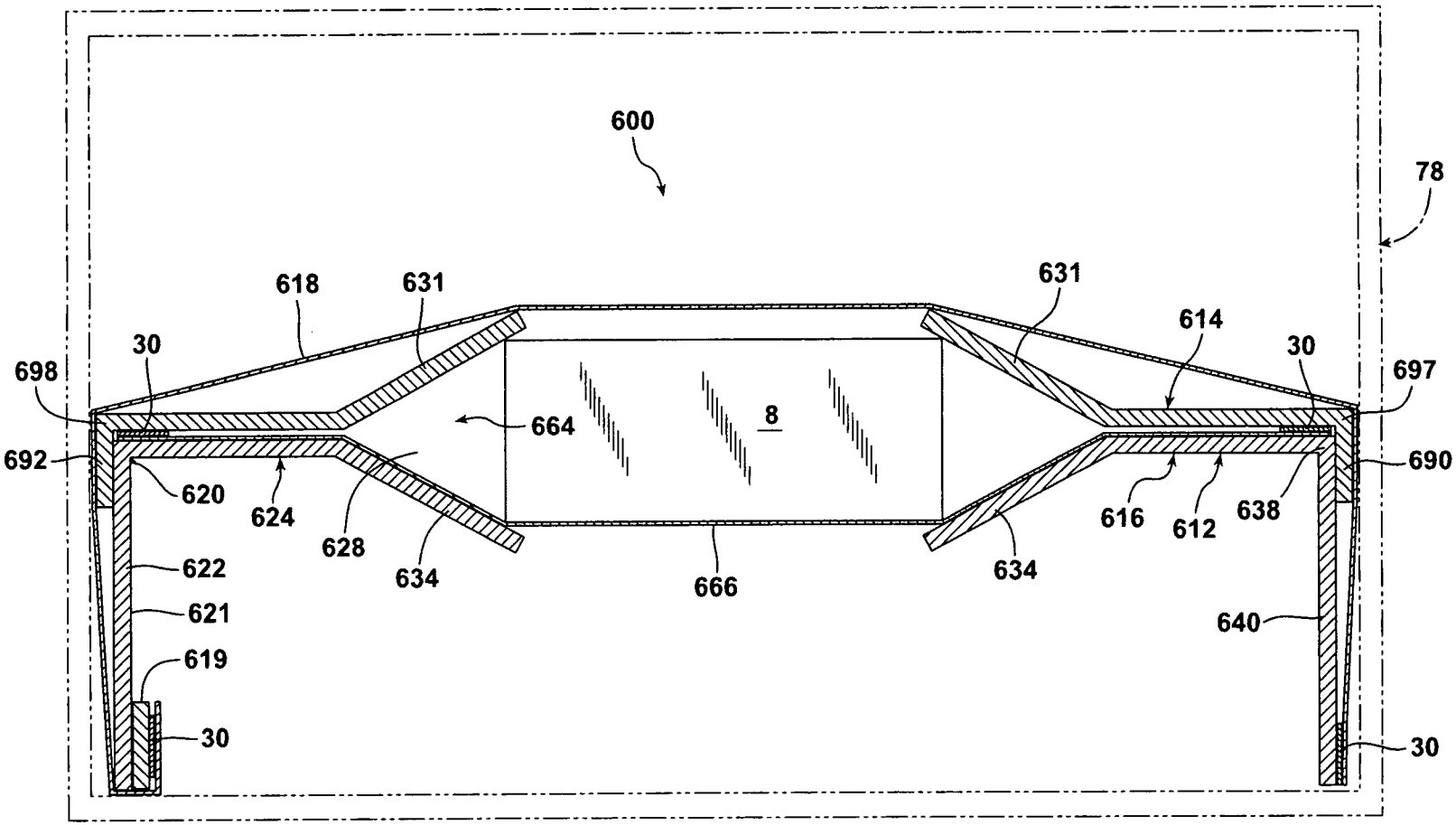
FIG. 18 is a representative sectional side view of packaging system 600 installed in box 78 and suspending product 8.
Figure 19:
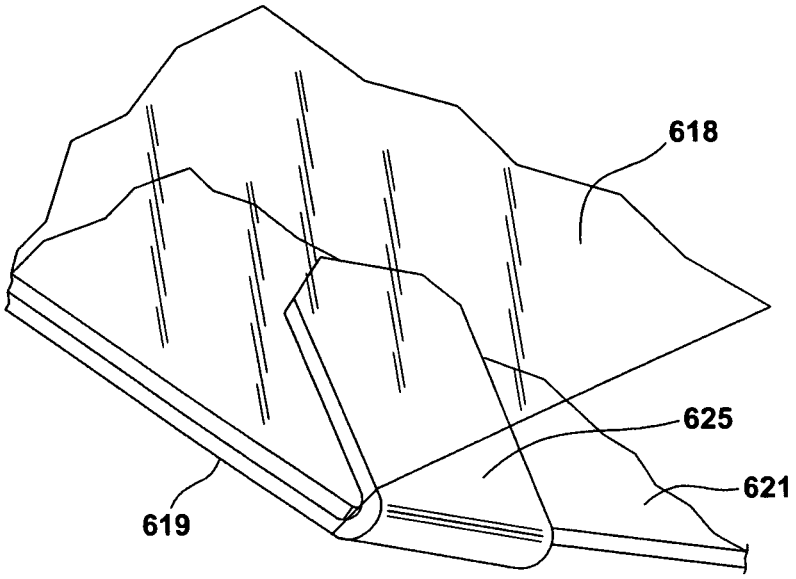
FIG. 19 is a representative perspective detail view of tab 625 of packaging system 600 in a folded configuration.

In use, the breakaway piece 619 may be detached along flap line of detachability 623 from the remainder portion 621. (FIG. 17.) This allows easier access to place tray 614 supporting product 8 on retention frame 612 to juxtapose tray opening 664 with panel opening 628. The breakaway piece 619 may be re-attached to the flap remainder portion 621 by placing breakaway piece 619 on the backside of the flap remainder portion 621 and folding the tabs 625 around the sides of the flap remainder portion 621 to position the tabs between retention sheet 618 and flap remainder portion 621. (FIGS. 18-19.) As a result, retention sheet 618 is again attached to first flap 622.

Also in use, the product 8 may be placed onto tray 614 by lifting one or more of the tray door portions 631 to insert at least a portion of product 8 between the tray sheet 666 and the tray door portions 631. (FIG. 18.)

Figure 20:
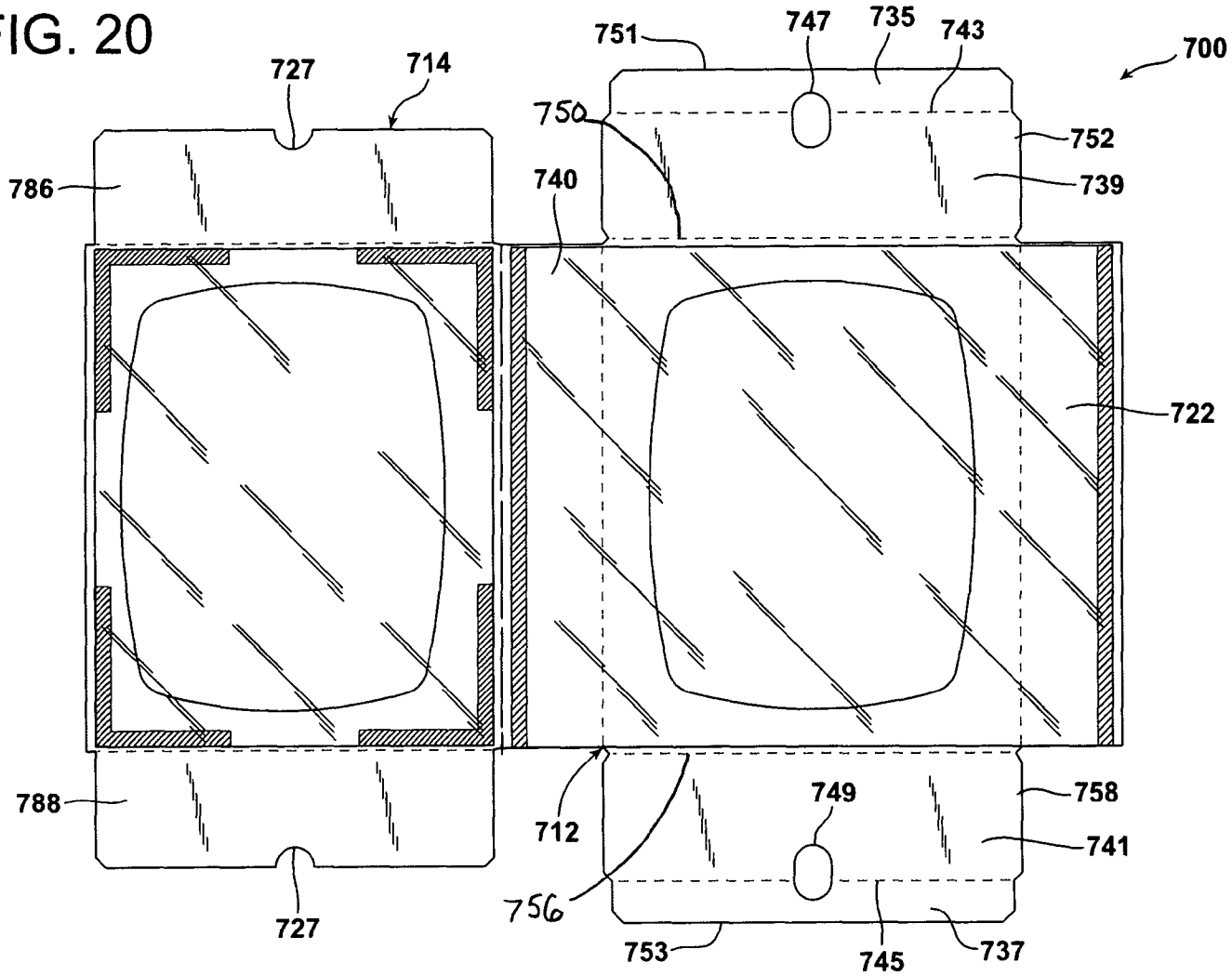
FIG. 20 is a representative top view of packaging system 700 in a lay-flat configuration.
Figure 21:
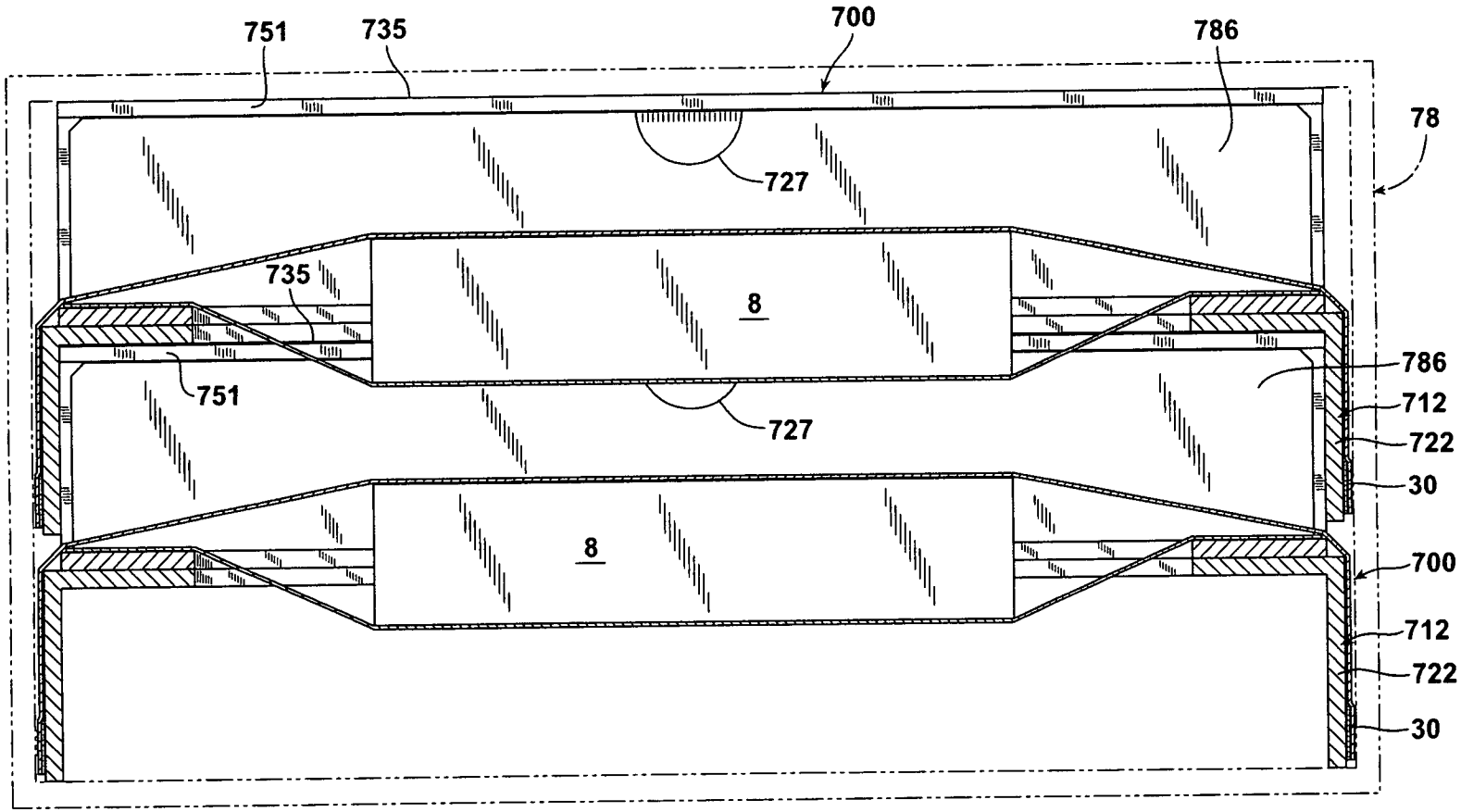
FIG. 21 is a representative sectional side view of two of packaging systems 700 in stacked arrangement installed in box 78 and suspending products 8.
Figure 22:
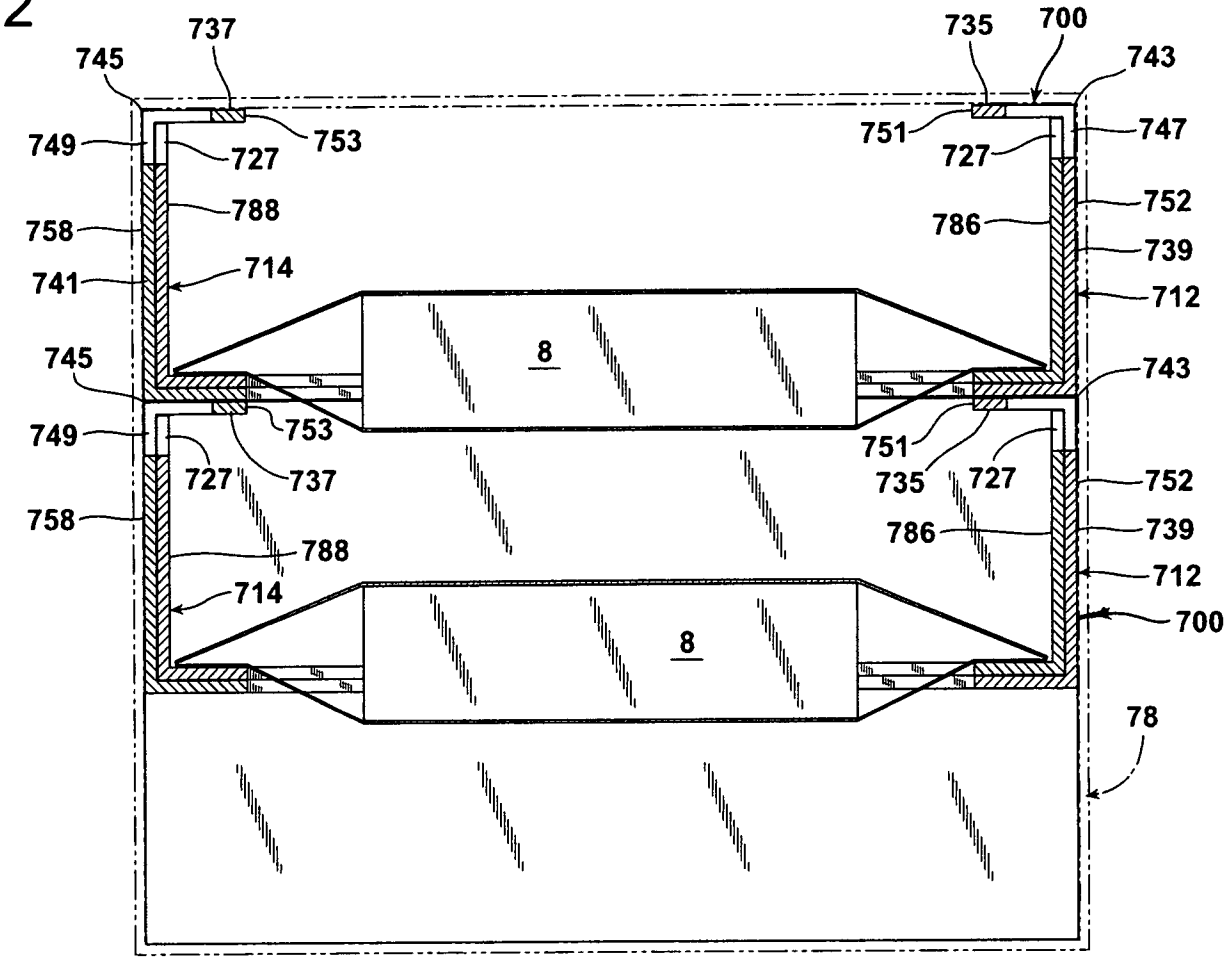
FIG. 22 is another representative sectional side view of two of packaging systems 700 in stacked arrangement installed in box 78 and suspending products 8.

Embodiment of FIGS. 20-22

Referring to FIGS. 20 to 22, another embodiment is shown as packaging system 700. Although all of the systems may be installed as stacked multiple systems within a box, packaging system 700 is advantageous for installing multiple systems in a box. Most of the elements of packaging system 700 can be the same as those described herein with respect to the other embodiments, as would be apparent to one of skill in the art, and therefore for the sake of brevity those like or similar elements are not repeated in detail here. However, a feature of interest with respect to packaging system 700 and not previously described is first and second rails 735, 737, which facilitate the stacked arrangement of multiple packaging systems 700 in a box (FIGS. 21-22).

First leg portion 752 includes first rail fold line 743, which may be generally parallel to third fold line 750, and defining first rail 735 and first leg remainder portion 752. First leg portion 752 may define finger hold 747, which may be intersected by first rail fold line 743. Second leg portion 758 includes second rail fold line 745, which may be generally parallel to third fold line 756, defining second rail 737 and second leg remainder portion 741. Second leg portion 758 may define finger hold 749, which may be intersected by second rail fold line 745. The first and second rails 735, 737 terminate in first and second rail edges 751, 753 respectively, which may form a portion of the outer perimeter of retention frame 712. The first and second rail fold lines 743, 745 may be spaced from and generally parallel to the first and second rail edges, respectively. The first and second tray leg portions 786, 788 of tray 714 may define notches 727.

In use, first and second flaps 722, 740 of retention frame 712 may be placed in the retention position, as previously described and as shown in FIGS. 21-22. First rail 735 may be folded along fold line 743 so that the first rail extends inwardly toward the interior of retention frame 712 and generally perpendicularly to the first leg remainder portion 752. (FIGS. 21-22.) Similarly, second rail 737 may be folded along fold line 745 so that the second rail extends inwardly toward the interior of retention frame 712 and generally perpendicularly to the second leg remainder portion 741. As such, the first and second rails provide a supportive surface upon which another packaging system, such as packaging system 700, may be stacked.

Figure 26:
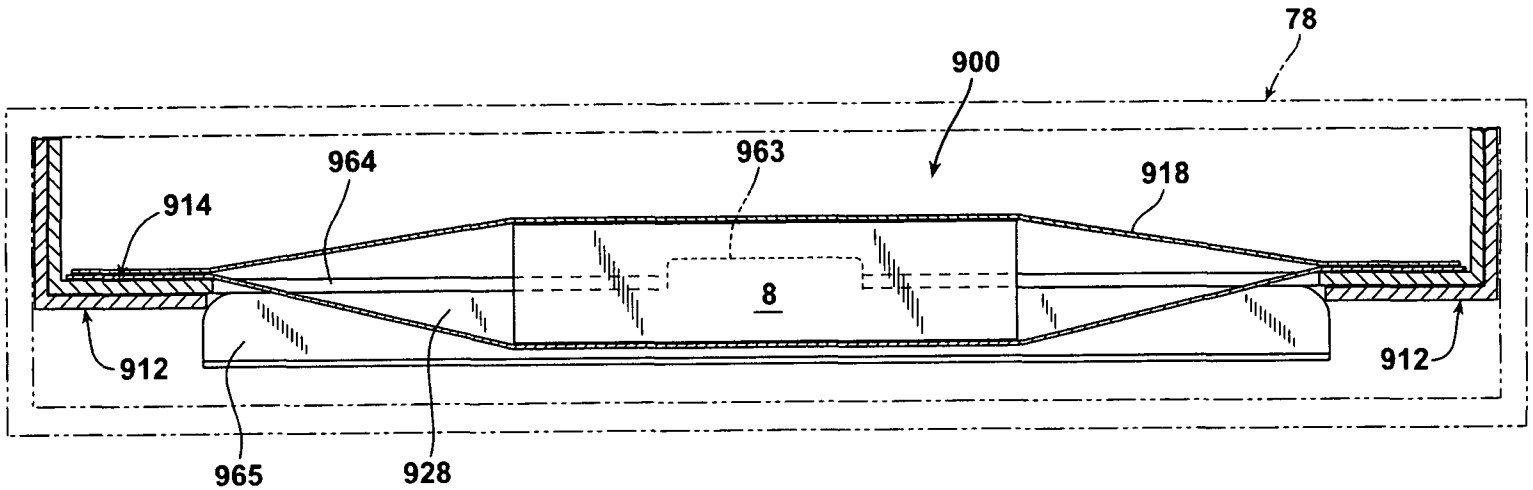
FIG. 26 is another representative sectional side view of packaging system 900 installed in box 78 and suspending product 8.

Embodiment of FIGS. 24-26

Referring to FIGS. 24 to 26, another embodiment is shown as packaging system 900. Most of the elements of packaging system 900 can be the same as those described herein with respect to the other embodiments, as would be apparent to one of skill in the art, and therefore for the sake of brevity those like or similar elements are not repeated in detail here. However, two features are of interest with respect to packaging system 900 that have not previously been described.

The first such feature is first and second flap additional fold lines 955, 957 of retention frame 912. First flap 922 comprises first flap additional fold line 955 between first fold line 920 and the first flap bottom edge 926. The first flap additional fold line 955 may also be between first fold line 920 and the first flap attachment zone 932. The first flap additional fold line 955 may be generally parallel to any or all of first fold line 920, first flap bottom edge 926, and first flap attachment zone 932.

Similarly, second flap 940 comprises second flap additional fold line 957 between second fold line 938 and the second flap bottom edge 944. The second flap additional fold line 957 may also be between second fold line 938 and the second flap attachment zone 948. The second flap additional fold line 957 may be generally parallel to any or all of second fold line 938, second flap bottom edge 944, and second flap attachment zone 948.

In use, as the first and second flaps 922, 940 of retention frame 912 are lifted to extend upwardly from the lay-flat position and toward the retention sheet 918 over the panel opening 928 to create slack in the retention sheet, as previously described. However, the first flap 922 may be further folded along first flap additional fold line 955, and second flap 940 may also be further folded along second flap additional fold line 957, in a direction upwardly from the lay-flat position and toward the retention sheet 918 over the panel opening, to provide further slack in retention sheet 918. This may allow easier access to place tray 914 supporting product 8 on retention frame 912 to juxtapose tray opening 964 with panel opening 628.

To place the first flap 922 in the retention position (FIG. 25), the flap is further folded along first flap additional fold line 955 toward the interior of the retention frame (i.e., in a direction opposition from the direction used to create slack in the retention sheet), and may generally form a right angle within the first flap along first flap additional fold line 955. Likewise, to place the second flap 940 in the retention position (FIG. 25), the flap is further folded along second flap additional fold line 957 toward the interior of the retention frame (i.e., in a direction opposition from the direction used to create slack in the retention sheet), and may generally form a right angle within the second flap along second flap additional fold line 957.

The second feature of interest with respect to packaging system 900 that has not previously been described in conjunction with the other embodiments are first door tab 959 of first door portion 961 and second door tab 963 of second door portion 965 of retention frame 912. Although the function of door portions of retention frames have been described previously in conjunction with the other embodiments, the door tab portions are now described. The retention panel opening border 946 surrounds panel opening 928. The first door portion 961 extends into the panel opening and is foldably connected by first door portion fold line 967 to the panel opening border 946. First door tab 959 may be cut within panel 916 adjacent first door portion fold line 967 to interrupt the first door portion fold line 967 and divide the first door portion fold line 967 into multiple segments so that the first door tab extends from the first door portion in a direction away from panel opening 928. Similarly, the second door portion 965 extends into the panel opening and is foldably connected by second door portion fold line 969 to the panel opening border 946. Second door tab 963 may be cut within panel 916 adjacent second door portion fold line 967 to interrupt the second door portion fold line 969 and divide the second door portion fold line 969 into multiple segments so that the second door tab extends from the second door portion in a direction away from panel opening 928. (FIG. 24.)

In installing tray 914 (supporting product 8) between retention sheet 918 and the remainder portion 924 of panel 916 to juxtapose tray opening 964 with panel opening 928, the first and second door portions may be moved or forced downwardly so that in effect the door portions pivot about their respective first and second door portion fold lines 967, 969. As a result, the first and second door tab portions 959, 963 are caused to move and extend upwardly above the tray opening border 968. In this orientation, the door tabs may help secure or "lock" the tray in the desired position juxtaposing the tray opening 964 with the panel opening 928.

Figure 27:
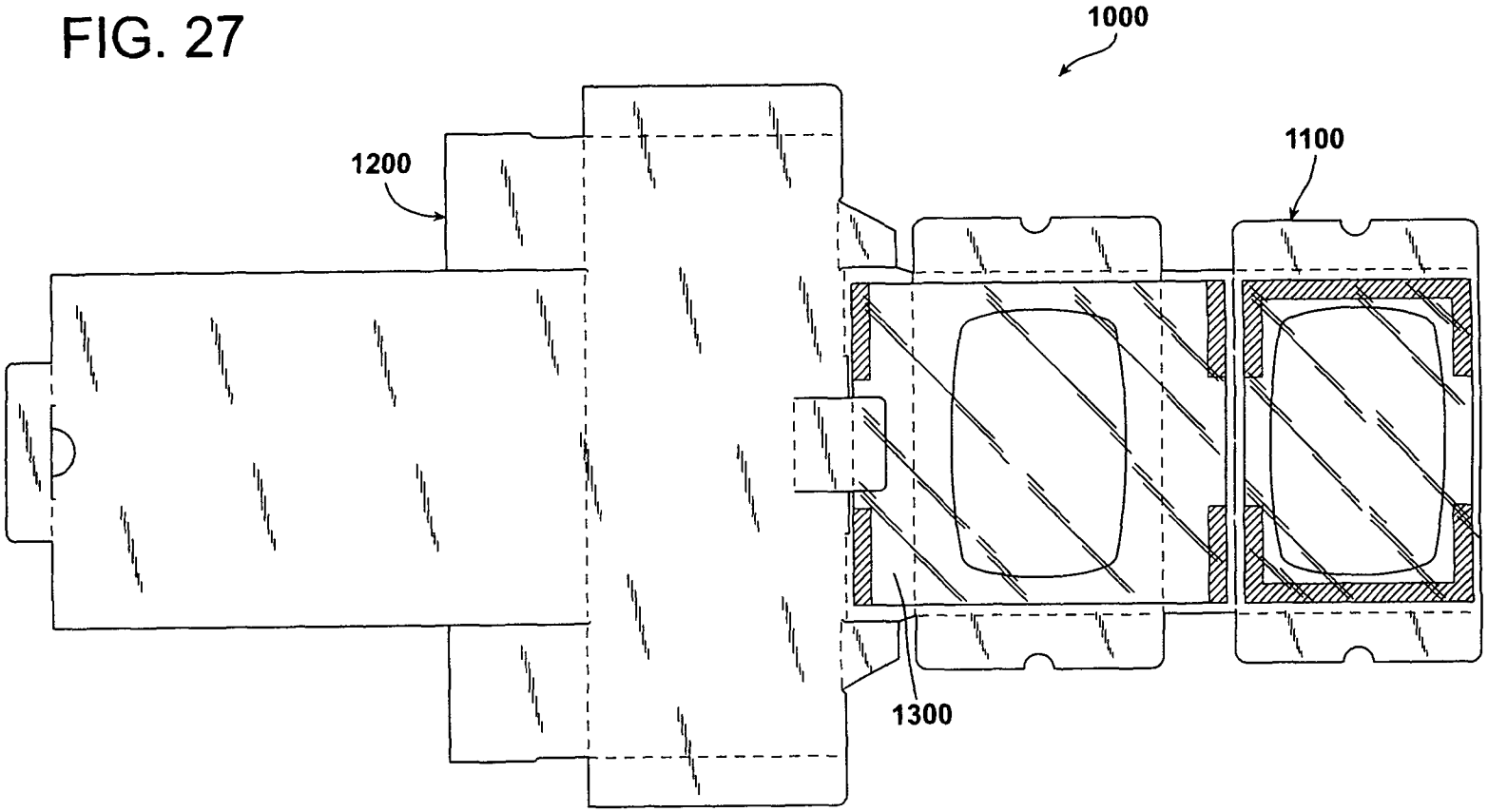
FIG. 27 is a representative top view of packaging precursor 1000 in a lay-flat configuration.
Figure 28:
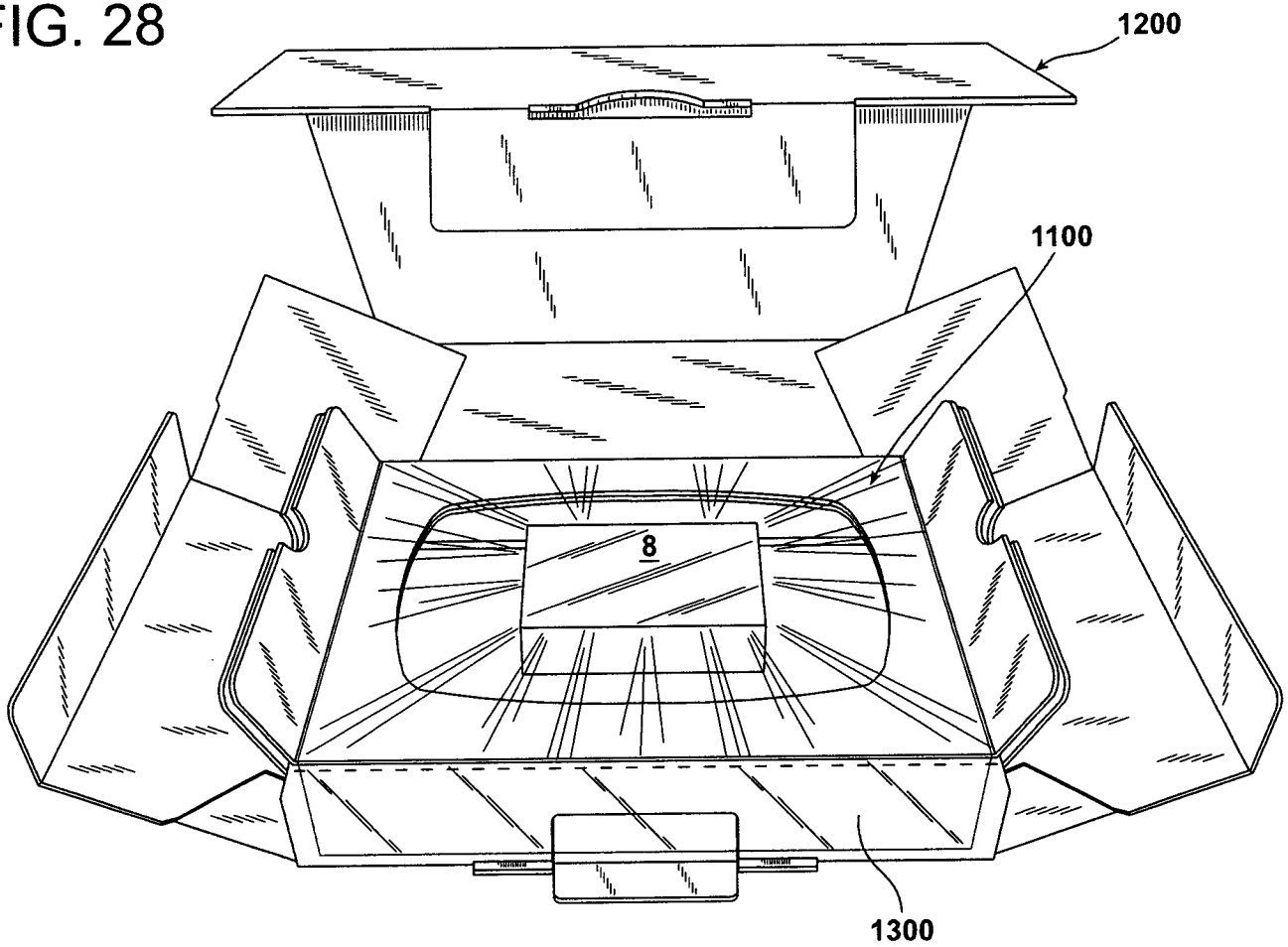
FIG. 28 is a representative perspective view of the packaging precursor of FIG. 27 being formed into a box.
Figure 29:
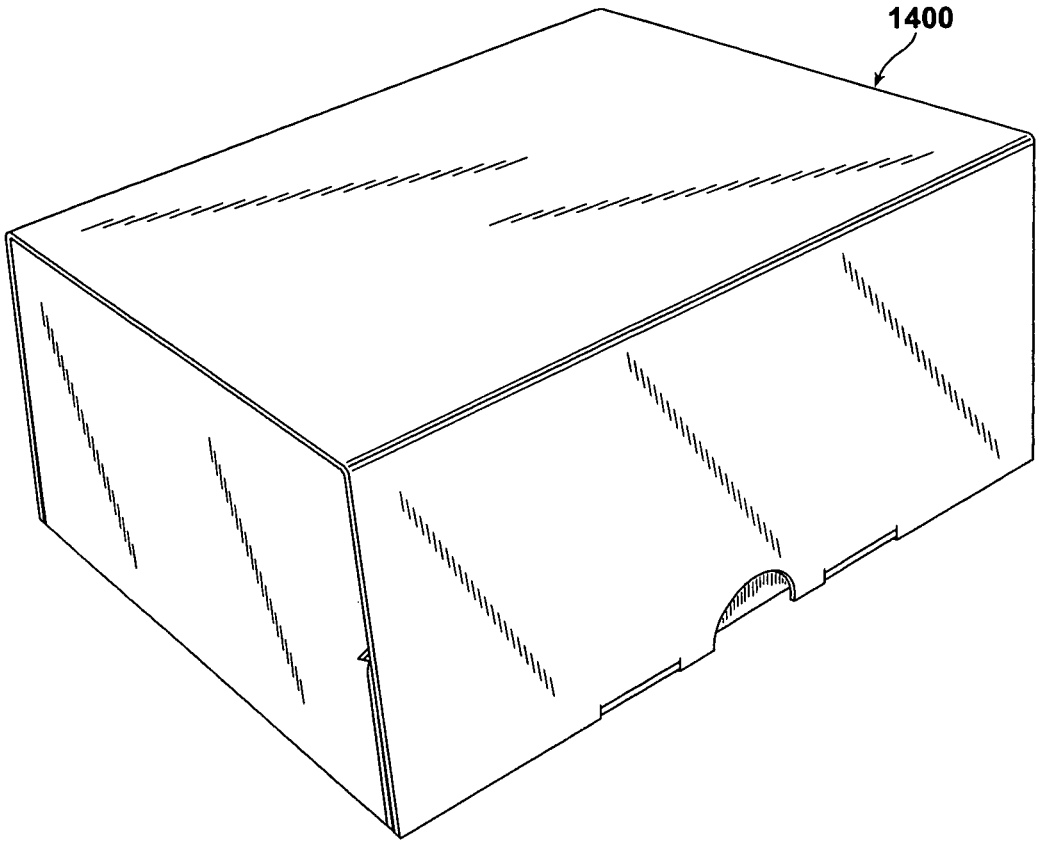
FIG. 29 is a representative perspective view of a completed box formed from the packaging precursor of FIG. 27.

Embodiment of FIGS. 27-29

Referring to FIGS. 27 to 29, another embodiment is shown as packaging precursor 1000 comprising a packaging system 1100 and an unfolded (i.e., unassembled) box 1200 connected to the packaging system. The unfolded box 1200 may have a lay-flat configuration, as shown in FIG. 27. Suitable examples of unfolded box 1200 include, for example, RELF, RETT, and/or STE types of boxes.

Suitable packaging systems for connection to the unfolded box include one or more of any of the packaging systems described herein. The packaging system may be detachably connected to the unfolded box (not illustrated). However, as shown in FIGS. 27-29, the packaging system 1100 may be connected to unfolded box 1200 by having an integral portion 1300 of the packaging system 1100 integral with the unfolded box 1200, that is, so that integral portion 1300 forms part of both the unfolded box 1200 and the packaging system 1100. The packaging system 1100 may have a lay-flat configuration, and may be coplanar with the lay-flat configuration of unfolded box 1200, as shown in FIG. 27.

In use, the packaging system 1100 may be used to suspend product 8 (as described above) and the unfolded box may be folded (FIG. 28) to form the completed, folded box 1400 (FIG. 29) enclosing the packaging system 1100.

Additional embodiments are described in the following sentences A through AA:

A. A packaging system comprising:
a retention frame comprising:
a panel having a first fold line defining a first flap and a remainder portion, wherein the remainder portion defines a panel opening; and
a retention sheet attached to the first flap and the remainder portion, wherein the retention sheet extends over the panel opening and the first fold line; and
a tray comprising:
a tray frame defining a tray opening; and
a tray sheet attached to the tray frame and extending over the tray opening, wherein the tray is configured for positioning between the retention sheet and the remainder portion of the retention frame to juxtapose the tray opening with the panel opening.

B. The packaging system of sentence A wherein the remainder portion has a second fold line defining a second flap and a central panel portion between the first and second fold lines, wherein:
the central panel portion defines the panel opening; and
the retention sheet is attached to the second flap and extends over the second fold line.

C. The packaging system of any preceding sentence wherein the panel comprises a panel door portion extending into the panel opening and foldably connected to the remainder portion along a panel door portion fold line.

D. The packaging system of sentence C wherein:
a first door tab is adjacent the panel door portion fold line, divides the door portion fold line into multiple segments, and extends from the first door portion away from the panel opening; and
moving the door portion downwardly by folding along the door portion fold line causes the door tab to move upwardly.

E. The packaging system of any preceding sentence wherein the tray frame comprises:
a tray opening border surrounding the tray opening; and
a tray door portion extending into the tray opening and foldably connected to the tray opening border along a tray door portion fold line.

F. The packaging system of any preceding sentence wherein the tray frame has first and second reinforcement portion fold lines generally parallel to each other and defining the tray frame into a first reinforcement portion, a second reinforcement portion, and a central tray portion between the first and second reinforcement portion fold lines and defining the tray opening, the first and second reinforcement portions extending in opposite directions from, and foldably connected to, the central tray portion.

G. The packaging system of sentence F wherein the first and second reinforcement portion fold lines are oriented in the tray frame so that the tray opening is juxtaposable with the panel opening to align the first reinforcement portion fold line of the tray frame with the first fold line of the retention frame and to align the second reinforcement portion fold line of the tray frame with the second fold line of the tray frame.

H. The packaging system of sentences F or G wherein the length of the first reinforcement portion fold line is less than the corresponding length of the central tray portion, whereby the first reinforcement portion has a tab configuration.

I. The packaging system of any preceding sentence wherein:
the first flap comprises a breakaway piece line of detachability generally parallel to the first fold line and defining the first flap into a breakaway piece and a flap main portion;
the retention sheet is attached to the breakaway piece; and
the breakaway piece is adapted for detachment along the breakaway piece line of detachability and subsequent reattachment to the flap main portion.

J. The packaging system of any preceding sentence wherein:
the remainder portion defines a plurality of panel openings;
the tray frame defines a plurality of tray openings; and
the tray is configured for positioning between the retention sheet and the remainder portion to juxtapose each of the tray openings with a corresponding panel opening.

K. The packaging system of any preceding sentence wherein:
the retention sheet is attached to the first flap in an attachment zone; and
the first flap has an additional fold line generally parallel to the first fold line and between the first fold line and the attachment zone.

L. The packaging system of any of sentences B through K wherein the first and second flaps are foldable to a retention position having the first and second flaps extending generally perpendicularly to the central panel portion and downwardly from the retention sheet extending over the panel opening.

M. The packaging system of sentence L wherein:
the remainder portion has a third fold line extending generally perpendicularly to the first fold line and defining a first leg portion extending from the central panel portion to define a top edge of the first leg portion;
the remainder portion has a fourth fold line extending generally parallel to the third fold line and defining a second leg portion extending opposite the first leg portion from the central panel portion to define a top edge of the second leg portion; and
the first and second legs are foldable to a spacing position wherein the first and second legs extend generally perpendicularly to the central panel portion and in a direction opposite to the retention position of the first and second flaps.

N. The packaging system of sentence M wherein the first leg portion comprises a first rail fold line generally parallel to the third fold line and defining a first rail portion and a first leg remainder portion, wherein when the first leg portion is in the spacing position, the first leg is foldable along the first rail fold line so that the first rail portion extends inwardly toward the panel opening and generally perpendicularly to the first leg remainder portion.

O. The packaging system of any of sentences N or M wherein the tray frame has first and second tray leg fold lines generally parallel to each other and defining the tray frame into a first tray leg portion, a second tray leg portion, and a central tray portion between the first and second tray leg fold lines and defining the tray opening, the first and second tray leg portions extending in opposite directions from, and foldably connected to, the central tray portion.

P. The packaging system of sentence O wherein the first and second tray leg fold lines are oriented in the tray frame so that the tray opening is juxtaposable with the panel opening to align the third fold line of the retention frame with the first tray leg fold line and align the fourth fold line of the retention frame with the second tray leg fold line.

Q. The packaging system of any of sentences M through P wherein the retention frame having the first and second flaps in the retention position and having the first and second legs in the spacing position is installable in a box to maintain the first and second flaps in the retention position and the first and second legs in the spacing position.

R. A package comprising:

a box; and the packaging system of sentence Q installed in the box to maintain the first and second flaps in the retention position and the first and second legs of the retention frame in the spacing position wherein the tray is between the retention sheet and the remainder portion of the retention frame to juxtapose the tray opening with the panel opening.

S. The package of sentence R comprising a plurality of the packaging systems installed in the box in stacked arrangement.

T. The package of any of sentences R or S wherein the box has an interior length corresponding to the distance between the first and second fold lines;

an interior width corresponding to the distance between the third and fourth fold lines, and an interior height corresponding to the retention frame height defined by the summation of (i) the perpendicular distance from the top plane surface of the central panel portion to the top edge of the first leg portion in the spacing position and (ii) the perpendicular distance from the top plane of the central panel portion to the bottom edge of the first flap in the retention position.

U. The packaging system of any preceding sentence wherein the tray is between the retention sheet and the remainder portion of the retention frame to juxtapose the tray opening with the panel opening.

V. The packaging system of sentence U for packaging a product wherein the tray sheet and retention sheet cooperate to define a product suspension space for suspending the product (i) between the tray sheet and the retention sheet and (ii) aligned with the juxtaposed tray opening and panel opening.

W. The packaging system of any of sentences A through Q wherein the tray and the retention frame are detachably connected to each other and in a lay-flat, coplanar arrangement.

X. A package precursor comprising:

the packaging system of sentence W; and an unfolded box in a lay-flat configuration coplanar with the packaging system and connected to the packaging system.

Y. The packaging precursor of sentence X wherein an integral portion forms part of both the packaging system and the unfolded box.

Z. A method of packaging a product comprising:

providing the packaging system of any of sentences A through Q;

placing the product on the tray to support the product on the tray sheet and over the tray opening;

inserting the tray and product supported by the tray between the retention sheet and the remainder portion of the retention frame to juxtapose the tray opening with the panel opening so that the tray is adjacent the remainder portion and the product is aligned with the juxtaposed tray opening and panel opening; and folding the first flap downwardly from the retention sheet extending over the panel opening to retain the product between the retention sheet and the tray sheet.

AA. The method of sentence Z further comprising placing the tray, retention frame, and retained product in a box to maintain the retention of the product between the retention sheet and the tray sheet.

Any numerical value ranges recited herein include all values from the lower value to the upper value in increments of one unit provided that there is a separation of at least 2 units between any lower value and any higher value. As an example, if it is stated that the amount of a component or a value of a process variable (e.g., temperature, pressure, time) may range from any of 1 to 90, 20 to 80, or 30 to 70, or be any of at least 1, 20, or 30 and/or at most 90, 80, or 70, then it is intended that values such as 15 to 85, 22 to 68, 43 to 51, and 30 to 32, as well as at least 15, at least 22, and at most 32, are expressly enumerated in this specification. For values that are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

The above descriptions are those of various embodiments of the invention. Alterations and changes can be made without departing from the spirit and broader aspects of the invention as defined in the claims, which are to be interpreted in accordance with the principles of patent law, including the doctrine of equivalents. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. The definitions and disclosures set forth in the present Application control over any inconsistent definitions and disclosures that may exist in an incorporated reference. All references to ASTM tests are to the most recent, currently approved, and published version of the ASTM test identified, as of the priority filing date of this application. Each such published ASTM test method is incorporated herein in its entirety by this reference.

What is claimed is:

1. A packaging system for packaging a product comprising:

a product;

a retention frame comprising:

a panel having a first fold line defining a first flap and a remainder portion, wherein the remainder portion defines a panel opening; and a retention sheet attached to the first flap and the remainder portion, wherein the retention sheet extends over the panel opening and the first fold line; and a tray comprising:

a tray frame defining a tray opening; and a tray sheet attached to the tray frame and extending over the tray opening, wherein:

the tray is between the retention sheet and the remainder portion of the retention frame to juxtapose the tray opening with the panel opening;

the tray sheet and retention sheet cooperate to define a product suspension space for suspending the product (i) between the tray sheet and the retention sheet and (ii) aligned with the juxtaposed tray opening and panel opening;

the product is suspended in the product suspension space to contact both the tray sheet and the retention sheet.

2. The packaging system of claim 1 wherein the remainder portion has a second fold line defining a second flap and a central panel portion between the first and second fold lines, wherein:

the central panel portion defines the panel opening; and the retention sheet is attached to the second flap and extends over the second fold line.

3. The packaging system of claim 2 wherein the panel comprises a panel door portion extending into the panel opening and foldably connected to the remainder portion along a panel door portion fold line.

4. The packaging system of claim 2 wherein the tray frame has first and second reinforcement portion fold lines generally parallel to each other and defining the tray frame into a first reinforcement portion, a second reinforcement portion, and a central tray portion between the first and second reinforcement portion fold lines and defining the tray opening, the first and second reinforcement portions extending in opposite directions from, and foldably connected to, the central tray portion.

5. The packaging system of claim 4 wherein the first and second reinforcement portion fold lines are oriented in the tray frame so that the tray opening is juxtaposable with the panel opening to align the first reinforcement portion fold line of the tray frame with the first fold line of the retention frame and to align the second reinforcement portion fold line of the tray frame with the second fold line of the tray frame.

6. The packaging system of claim 2 wherein the first and second flaps are foldable to a retention position having the first and second flaps extending generally perpendicular to the central panel portion and downwardly from the retention sheet extending over the panel opening.

7. A packaging system comprising:

a retention frame comprising:

a panel having a first fold line defining a first flap and a remainder portion, wherein the remainder portion defines a panel opening and the remainder portion has a second fold line defining a second flap and a central panel portion between the first and second fold lines, wherein the central panel portion defines the panel opening; and a retention sheet attached to the first flap and the second flap of the remainder portion, wherein the retention sheet extends over the panel opening, the first fold line, and the second fold line; wherein the first and second flaps are foldable to a retention position having the first and second flaps extending generally perpendicular to the central panel portion and downwardly from the retention sheet extending over the panel opening; and a tray comprising:

a tray frame defining a tray opening; and a tray sheet attached to the tray frame and extending over the tray opening, wherein the tray is configured for positioning between the retention sheet and the remainder portion of the retention frame to juxtapose the tray opening with the panel opening; wherein:

the remainder portion has a third fold line extending generally perpendicularly to the first fold line and defining a first leg portion extending from the central panel portion to define a top edge of the first leg portion;

the remainder portion has a fourth fold line extending generally parallel to the third fold line and defining a second leg portion extending opposite the first leg portion from the central panel portion to define a top edge of the second leg portion; and the first and second legs are foldable to a spacing position wherein the first and second legs extend generally perpendicularly to the central panel portion and in a direction opposite to the retention position of the first and second flaps.

8. The packaging system of claim 7 wherein the tray frame has first and second tray leg fold lines generally parallel to each other and defining the tray frame into a first tray leg portion, a second tray leg portion, and a central tray portion between the first and second tray leg fold lines and defining the tray opening, the first and second tray leg portions extending in opposite directions from, and foldably connected to, the central tray portion.

9. The packaging system of claim 8 wherein the first and second tray leg fold lines are oriented in the tray frame so that the tray opening is juxtaposable with the panel opening to align the third fold line of the retention frame with the first tray leg fold line and align the fourth fold line of the retention frame with the second tray leg fold line.

10. The packaging system of claim 7 wherein the retention frame having the first and second flaps in the retention position and having the first and second legs in the spacing position is installable in a box to maintain the first and second flaps in the retention position and the first and second legs in the spacing position.

11. A package comprising:

a box; and the packaging system of claim 10 installed in the box to maintain the first and second flaps in the retention position and the first and second legs of the retention frame in the spacing position wherein the tray is between the retention sheet and the remainder portion of the retention frame to juxtapose the tray opening with the panel opening.

12. The package of claim 11 comprising a plurality of the packaging systems installed in the box in stacked arrangement.

13. The package of claim 11 wherein the box has an interior length corresponding to the distance between the first and second fold lines;

an interior width corresponding to the distance between the third and fourth fold lines, and an interior height corresponding to the retention frame height defined by the summation of (i) the perpendicular distance from the top plane surface of the central panel portion to the top edge of the first leg portion in the spacing position and (ii) the perpendicular distance from the top plane of the central panel portion to the bottom edge of the first flap in the retention position.

14. A packaging system comprising:

a retention frame comprising:

a panel having a first fold line defining a first flap and a remainder portion, wherein the remainder portion defines a panel opening and a panel opening border region bordering and coplanar with the panel opening; and a retention sheet attached to the first flap and the remainder portion, wherein the retention sheet extends over the panel opening and the first fold line; and a tray comprising:

a tray frame defining a tray opening and a tray opening border region bordering and coplanar with the tray opening; and a tray sheet attached to the tray frame and extending over the tray opening, wherein the tray and the retention frame are detachably connected to each other by a line of detachability and in a lay-flat, coplanar arrangement; and wherein the tray is configured for positioning (i) between the retention sheet and the remainder portion of the retention frame to juxtapose the tray opening with the panel opening and (ii) to contact the tray opening border region of the tray frame with the panel opening border region of the remainder portion of the retention frame to support the tray opening border region of the tray frame by the panel opening border region of the remainder portion of the retention frame.

15. A package precursor comprising:

the packaging system of claim 14; and an unfolded box in a lay-flat configuration coplanar with the packaging system and connected to the packaging system.

16. The packaging precursor of claim 15 wherein an integral portion forms part of both the packaging system and the unfolded box.

17. A packaging system comprising:

a retention frame comprising:

a panel having a first fold line defining a first flap and a remainder portion, wherein the remainder portion defines a panel opening and a panel opening border region bordering and coplanar with the panel opening; and a retention sheet attached to the first flap and the remainder portion, wherein the retention sheet extends over the panel opening and the first fold line; and a tray comprising:

a tray frame defining a tray opening and a tray opening border region bordering and coplanar with the tray opening; and a tray sheet attached to the tray frame and extending over the tray opening, wherein the tray is configured for positioning (i) between the retention sheet and the remainder portion of the retention frame to juxtapose the tray opening with the panel opening and (ii) to contact the tray opening border region of the tray frame that is coplanar with the tray opening with the panel opening border region of the remainder portion of the retention frame that is coplanar with the panel opening to support the tray opening border region of the tray frame by the panel opening border region of the remainder portion of the retention frame.

18. A method of packaging a product comprising:

providing the packaging system of claim 17;

placing the product on the tray to support the product on the tray sheet and over the tray opening;

inserting the tray and product supported by the tray between the retention sheet and the remainder portion of the retention frame to juxtapose the tray opening with the panel opening so that the tray opening border region of the tray frame that is coplanar with the tray opening contacts and is supported by the panel opening border region of the remainder portion that is coplanar with the panel opening and the product is aligned with the juxtaposed tray opening and panel opening; and folding the first flap downwardly from the retention sheet extending over the panel opening to retain the product between the retention sheet and the tray sheet.

19. The method of claim 18 further comprising placing the tray, retention frame, and retained product in a box to maintain the retention of the product between the retention sheet and the tray sheet.

* * * * *